US010066444B2

(12) United States Patent
Evans et al.

(10) Patent No.: US 10,066,444 B2
(45) Date of Patent: Sep. 4, 2018

(54) EARTH-BORING TOOLS INCLUDING SELECTIVELY ACTUATABLE CUTTING ELEMENTS AND RELATED METHODS

(71) Applicant: Baker Hughes Incorporated, Houston, TX (US)

(72) Inventors: Kenneth R. Evans, Spring, TX (US); Eric C. Sullivan, Houston, TX (US); Navish Makkar, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 288 days.

(21) Appl. No.: 14/957,186

(22) Filed: Dec. 2, 2015

(65) Prior Publication Data

US 2017/0159369 A1 Jun. 8, 2017

(51) Int. Cl.

| | |
|---|---|
| ***E21B 10/60*** | (2006.01) |
| ***E21B 43/26*** | (2006.01) |
| ***E21B 7/00*** | (2006.01) |

(52) U.S. Cl.

CPC ..... *E21B 10/60* (2013.01); *E21B 7/00* (2013.01); *E21B 43/26* (2013.01)

(58) Field of Classification Search

CPC ..... E21B 10/42; E21B 10/60; E21B 10/62; E21B 10/322; E21B 7/00; E21B 7/04; E21B 7/064; E21B 43/26

See application file for complete search history.

(56) References Cited

U.S. PATENT DOCUMENTS

| | | | | |
|---|---|---|---|---|
| 4,569,558 | A * | 2/1986 | Hood | E21C 35/187 299/16 |
| 4,662,458 | A | 5/1987 | Ho | |
| 5,042,596 | A | 8/1991 | Brett et al. | |
| 5,542,486 | A * | 8/1996 | Curlett | E21B 7/18 175/393 |
| 5,842,149 | A | 11/1998 | Harrell et al. | |
| 5,967,247 | A | 10/1999 | Pessier | |
| 6,021,377 | A | 2/2000 | Dubinsky et al. | |
| 6,123,160 | A | 9/2000 | Tibbitts | |
| 6,173,794 | B1 | 1/2001 | von Gynz-Rekowski et al. | |

(Continued)

*Primary Examiner* — Robert E Fuller
*Assistant Examiner* — David Carroll
(74) *Attorney, Agent, or Firm* — TraskBritt

(57) ABSTRACT

Method of operating earth-boring tools may involve activating a selectively activatable hydraulic fracturing device secured to the earth-boring tool to impact an underlying earth formation with a fluid from the selectively activatable hydraulic fracturing device. A crack may be at least one of initiated or propagated in a portion of the underlying earth formation utilizing the fluid in response to activation of the selectively activatable hydraulic fracturing device. The selectively activatable hydraulic fracturing device may be subsequently deactivated. Earth-boring tools may include a selectively activatable hydraulic fracturing device configured to transition between an activated state in which fluid is permitted to flow through the selectively activatable hydraulic fracturing device to engage with an underlying earth formation and a deactivated state in which fluid does not flow through the selectively activatable hydraulic fracturing device. The selectively activatable hydraulic fracturing device may be configured to at least one of initiate or propagate cracks.

19 Claims, 13 Drawing Sheets

(56) References Cited

U.S. PATENT DOCUMENTS

| | | | | |
|---|---|---|---|---|
| 6,173,797 | B1 | 1/2001 | Dykstra et al. | |
| 6,253,863 | B1 | 7/2001 | Mensa-Wilmot et al. | |
| 6,349,780 | B1 | 2/2002 | Beuershausen | |
| 6,785,641 | B1 | 8/2004 | Huang | |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 7,523,792 | B2 | 4/2009 | El-Rayes et al. | |
| 7,604,072 | B2 | 10/2009 | Pastusek et al. | |
| 7,849,934 | B2 | 12/2010 | Pastusek et al. | |
| 7,866,413 | B2 | 1/2011 | Stauffer et al. | |
| 7,921,937 | B2 | 4/2011 | Brackin et al. | |
| 7,987,925 | B2 | 8/2011 | Pastusek et al. | |
| 8,100,196 | B2 | 1/2012 | Pastusek et al. | |
| 8,505,634 | B2 | 8/2013 | Lyons et al. | |
| 8,794,356 | B2 | 8/2014 | Lyons et al. | |
| 8,851,207 | B2 | 10/2014 | Gavia et al. | |
| 9,080,399 | B2 | 7/2015 | Oesterberg | |
| 2005/0096847 | A1 | 5/2005 | Huang | |
| 2010/0212964 | A1 | 8/2010 | Beuershausen | |
| 2011/0100714 | A1 | 5/2011 | Moss et al. | |
| 2011/0155472 | A1 | 6/2011 | Lyons et al. | |
| 2012/0080240 | A1 | 4/2012 | Green et al. | |
| 2012/0273281 | A1 | 11/2012 | Burhan et al. | |
| 2012/0279785 | A1 | 11/2012 | Gavia et al. | |
| 2012/0318580 | A1* | 12/2012 | Oesterberg | E21B 7/064 175/57 |
| 2014/0020956 | A1 | 1/2014 | Cooley et al. | |
| 2014/0047776 | A1 | 2/2014 | Scott et al. | |
| 2014/0054087 | A1* | 2/2014 | Wang | E21B 7/06 175/61 |
| 2014/0223833 | A1 | 8/2014 | Welch et al. | |
| 2014/0311801 | A1* | 10/2014 | Jain | E21B 10/62 175/27 |
| 2014/0318873 | A1 | 10/2014 | Patel et al. | |
| 2014/0332271 | A1* | 11/2014 | Do | E21B 10/42 175/57 |
| 2014/0332283 | A1 | 11/2014 | Do et al. | |
| 2015/0034394 | A1 | 2/2015 | Gavia et al. | |
| 2015/0308203 | A1* | 10/2015 | Lewis | E21B 47/06 175/48 |
| 2017/0159370 | A1 | 6/2017 | Evans et al. | |
| 2017/0275951 | A1 | 9/2017 | Thomas | |

* cited by examiner

EARTH-BORING TOOLS INCLUDING SELECTIVELY ACTUATABLE CUTTING ELEMENTS AND RELATED METHODS

FIELD

This disclosure relates generally to earth-boring tools and methods of making and using earth-boring tools. More specifically, disclosed embodiments relate to earth-boring tools including selectively actuatable cutting elements configured to perform an initial crushing, gouging cutting action on an underlying earth formation upon actuation.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements mounted to a face of a bit body of the drill bit. The cutters are fixed in place when used to cut formation materials. A conventional fixed-cutter earth-boring rotary drill bit includes a bit body having generally radially projecting and longitudinally extending blades.

A plurality of cutting elements is positioned on each of the blades. Generally, the cutting elements have either a disk shape or, in some instances, a more elongated, substantially cylindrical shape. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements or cutters. The plurality of PDC cutting elements may be fixed within cutting element pockets formed in rotationally leading surfaces of each of the blades. Conventionally, a bonding material such as an adhesive or, more typically, a braze alloy may be used to secure the cutting elements to the bit body.

Some earth-boring tools may also include backup cutting elements, bearing elements, or both. Backup cutting elements are conventionally fixed to blades rotationally following leading cutting elements. The backup cutting elements may be located entirely behind associated leading cutting elements or may be laterally exposed beyond a side of a leading cutting element, longitudinally exposed above a leading cutting element, or both. As the leading cutting elements are worn away, the backup cutting elements may be exposed to a greater extent and engage with (e.g., remove by shearing cutting action) an earth formation. Similarly, some bearing elements have been fixed to blades rotationally following leading cutting elements. The bearing elements conventionally are located entirely behind associated leading cutting elements to limit depth-of-cut (DOC) as the bearing elements contact and ride on an underlying earth formation.

During drilling operations, the drill bit is positioned at the bottom of a well borehole and rotated.

BRIEF SUMMARY

In some embodiments, methods of operating earth-boring tools may involve activating a selectively activatable hydraulic fracturing device secured to the earth-boring tool to impact an underlying earth formation with a fluid from the selectively activatable hydraulic fracturing device. A crack may be at least one of initiated or propagated in a portion of the underlying earth formation utilizing the fluid in response to activation of the selectively activatable hydraulic fracturing device. The selectively activatable hydraulic fracturing device may subsequently be deactivated.

In other embodiments, earth-boring tools may include a body and blades extending outward from the body to a face. Shearing cutting elements may be mounted to the blades proximate rotationally leading surfaces of the blades. A selectively activatable hydraulic fracturing device may be mounted to a blade, the selectively activatable hydraulic fracturing device configured to transition between an activated state in which fluid is permitted to flow through the selectively activatable hydraulic fracturing device to engage with an underlying earth formation and a deactivated state in which fluid does not flow through the selectively activatable hydraulic fracturing device. The selectively activatable hydraulic fracturing device may be configured to perform at least one of crack initiation or crack propagation within the earth formation at least upon initial activation into the activated state.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular apparatus or component thereof, but are merely idealized representations employed to describe illustrative embodiments. Thus, the drawings are not necessarily to scale.

Although some embodiments of selectively actuatable cutting elements in this disclosure are depicted as being used and employed in earth-boring drill bits, such as fixed-cutter earth-boring rotary drill bits, sometimes referred to as "drag" bits, selectively actuatable cutting elements in accordance with this disclosure may be employed in any earth-boring tool employing a structure comprising a superhard polycrystalline material attached to a supporting substrate. Accordingly, the terms "earth-boring tool" and "earth-boring drill bit," as used in this disclosure, mean and include any type of bit or tool used for drilling during the formation or enlargement of a wellbore in a subterranean formation and include, for example, rolling cone bits, percussion bits, core bits, eccentric bits, bicenter bits, reamers, mills, hybrid bits, and other drilling bits and tools known in the art.

As used in this disclosure, the term "superhard material" means and includes any material having a Knoop hardness value of about 3,000 $Kg_f/mm^2$ (29,420 MPa) or more. Superhard materials include, for example, diamond and cubic boron nitride. Superhard materials may also be characterized as "superabrasive" materials.

As used in this disclosure, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material. Polycrystalline materials include, for example, polycrystalline diamond (PCD) and polycrystalline cubic boron nitride (CBN).

As used in this disclosure, the WI is "interbonded" and "inter-granular bond" mean and include any direct atomic bond (e.g., covalent, ionic, metallic, etc.) between atoms in adjacent grains of material.

Figure 1:
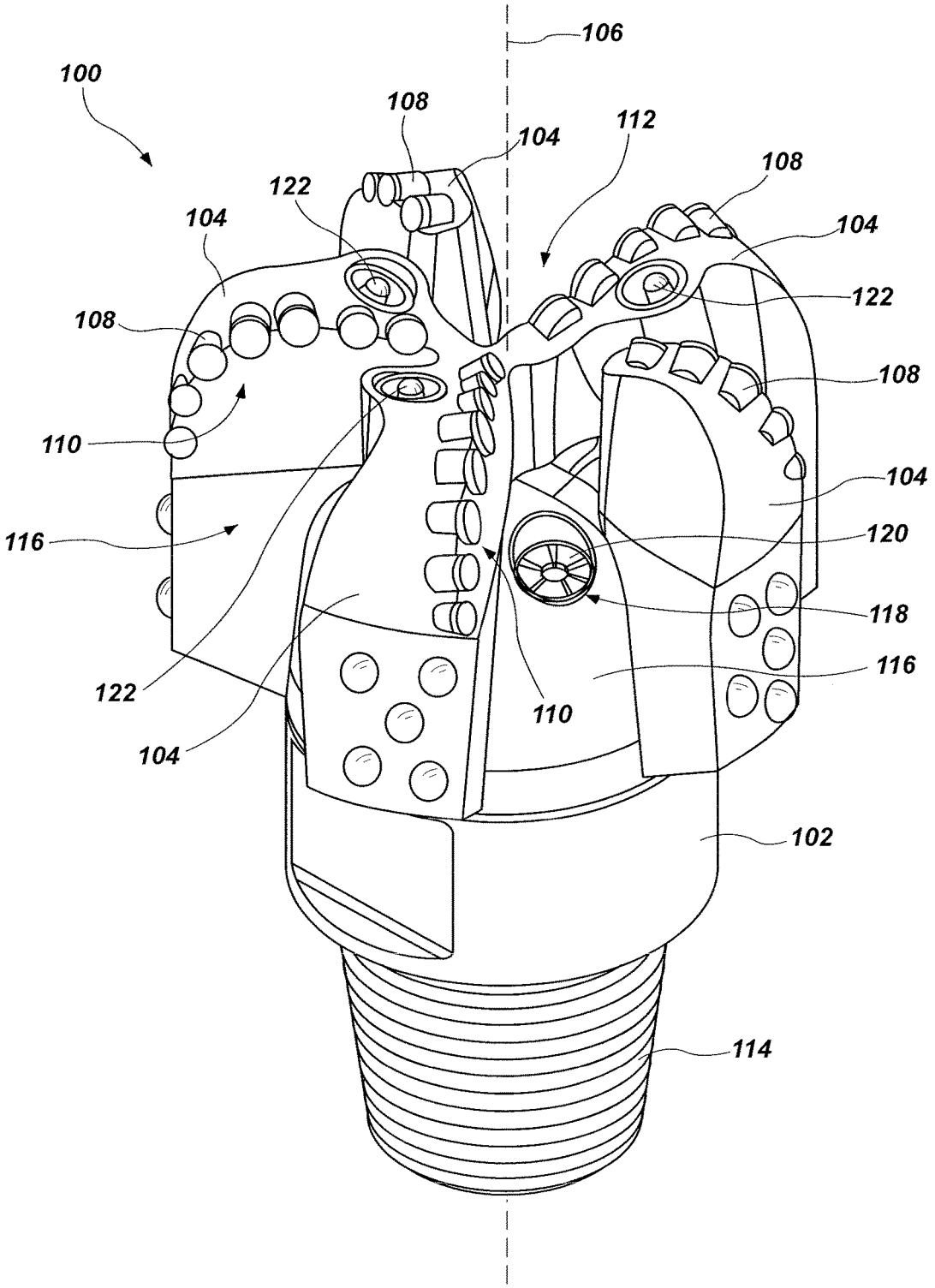
FIG. 1 is a perspective view of an earth-boring tool including selectively actuatable cutting elements within the scope of this disclosure.

Referring to FIG. 1, a perspective view of an earth-boring tool 100 is shown. The earth-boring tool 100 of FIG. 1 is configured as an earth-boring rotary drill bit, which is, more specifically, a drag bit. The earth-boring tool 100 may include a body 102 configured to be rotated while the earth-boring tool 100 is located in a borehole to remove an underlying earth formation. Blades 104 may extend outwardly from the body 102 in both radial and longitudinal directions (e.g., both parallel and perpendicular to a longitudinal axis 106 of the body 102, which may correspond, for example, to an axis of rotation or a geometrical center of the body 102). A face 112 of the earth-boring tool 100 may be located at outer surfaces of the blades 104 at the leading end of the earth-boring tool 100. The body 102 of the earth-boring tool 100 may be mounted to a shank 114 at a trailing end of the earth-boring tool 100, the shank 114 having a threaded connection portion, which may conform to industry standards, such as those promulgated by the American Petroleum Institute (API), for attaching the earth-boring tool 100 to a drill string.

Junk slots 116 may be located between the blades 104 to enable cuttings removed by the earth-boring tool 100 to travel between the blades 104, through the junk slots 116, away from the face 112. Internal fluid passageways may extend within the body 102 between fluid ports 118 at the leading end of the body 102 proximate the face 112 and a longitudinal bore that extends through the shank 114 and partially through the body 102. Nozzle inserts 120 may be mounted within the fluid ports 118 of the internal fluid passageways to direct the flow of drilling fluid flowing through the fluid ports.

In some embodiments, one or more shearing cutting elements 108 may be mounted to the earth-boring tool 100. For example, shearing cutting elements 108 shaped and positioned to remove an underlying earth formation by a shearing cutting action may be mounted to the blades 104 proximate rotationally leading surfaces 110 of the blades 104 at the face 112 of the earth-boring tool 100.

One or more selectively actuatable cutting elements 122 may be mounted to the earth-boring tool 100. The selectively actuatable cutting elements 122 may be extensible, such that they may be movable outward from the earth-boring tool 100. More specifically, the selectively actuatable cutting elements 122 may extend outwardly from the face 112 of the earth-boring tool 100, for example, to begin engagement with an underlying earth formation and may retract back toward the face 112 to cease engagement with the underlying earth formation. When the selectively actuatable cutting elements 122 extend and engage with the underlying earth formation, they may perform at least one of a gouging or crushing cutting action to weaken and remove the earth formation.

In some embodiments, such as that shown in FIG. 1, a selectively actuatable cutting element 122 may be mounted to a blade 104 of the earth-boring tool 100. More specifically, the selectively actuatable cutting element 122 may be positioned at least partially within the blade 104 and may be located on the blade 104 at a location rotationally trailing the rotationally leading surface 110 of the blade 104. As a specific, nonlimiting example, the selectively actuatable cutting element 122 may be located on the blade 104 at a location rotationally trailing the shearing cutting elements 108 located on the blade 104. In some embodiments, such as that shown in FIG. 1, selectively actuatable cutting elements 122 may be mounted to fewer than all the blades 104 of the earth-boring tool 100. In other embodiments, at least one selectively actuatable cutting element 122 may be mounted to each blade 104 of the earth-boring tool 100.

In some embodiments, a selectively actuatable cutting element 122 may be rotationally aligned with a shearing cutting element 108 (e.g., may rotationally lead or trail the shearing cutting element 108). For example, the shearing cutting element 108 and the selectively actuatable cutting element 122 may be located at the same radial position and the same longitudinal position on the earth-boring tool 100 relative to the longitudinal axis 106 of the earth-boring tool 100. The shearing cutting element 108 may be located on the same blade 104 as the selectively actuatable cutting element 122 or may be located on a different blade 104 from the selectively actuatable cutting element 122. In other embodiments, the selectively actuatable cutting element 122 may not be rotationally aligned with any shearing cutting element 108.

Figure 2:
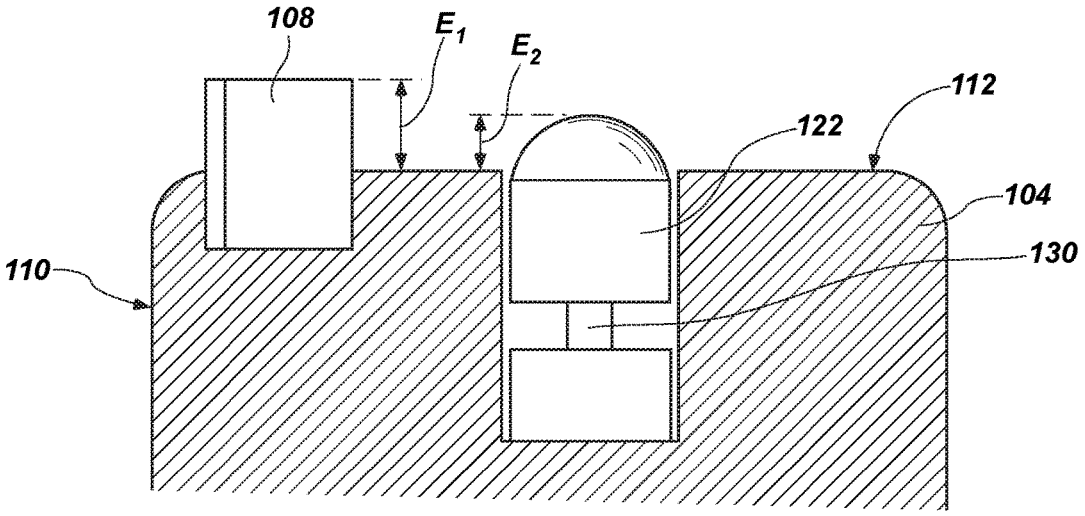
FIG. 2 is a simplified cross-sectional view of a blade of the earth-boring tool of FIG. 1 illustrating a cutting element in a retracted position.

FIG. 2 is a simplified cross-sectional view of a blade 104 of the earth-boring tool 100 of FIG. 1. The selectively actuatable cutting element 122 mounted to the blade 104 of FIG. 2 may be in a first, pre-actuation, retracted state. When the selectively actuatable cutting element 122 is in the first state, the selectively actuatable cutting element 122 may not engage with an underlying earth formation. For example, the selectively actuatable cutting element 122 may be underexposed relative to other cutting elements of the earth-boring tool 100, such as the shearing cutting element 108 shown in FIG. 2. More specifically, a maximum exposure $E_1$ of the shearing cutting element 108 above a face 112 of the blade 104 may be greater than a maximum retracted exposure $E_2$ of the selectively actuatable cutting element 122 above the face 112. As a specific, nonlimiting example, a difference between the maximum exposure $E_1$ of the shearing cutting element 108 above the face 112 and the maximum retracted exposure $E_2$ of the selectively actuatable cutting element 122 above the face 112 may be greater than a depth of cut of the shearing cutting element 108 (i.e., greater than a depth of penetration of the shearing cutting element 108 into the underlying earth formation). The selectively actuatable cutting element 122 may be located on the same blade 104 as the shearing cutting element 108 in some embodiments, such as that shown in FIG. 2. In other embodiments, the selectively actuatable cutting element 122 may be located on a different blade 104 from the shearing cutting element 108. The selectively actuatable cutting element 122 may be located at about the same radial position away from, and at about the same longitudinal position along, the longitudinal axis 106 (see FIG. 1) as the shearing cutting element 108. For example, the selectively actuatable cutting element 122 may be positioned to traverse at least substantially the same cutting path as the shearing cutting element 108.

Figure 3:
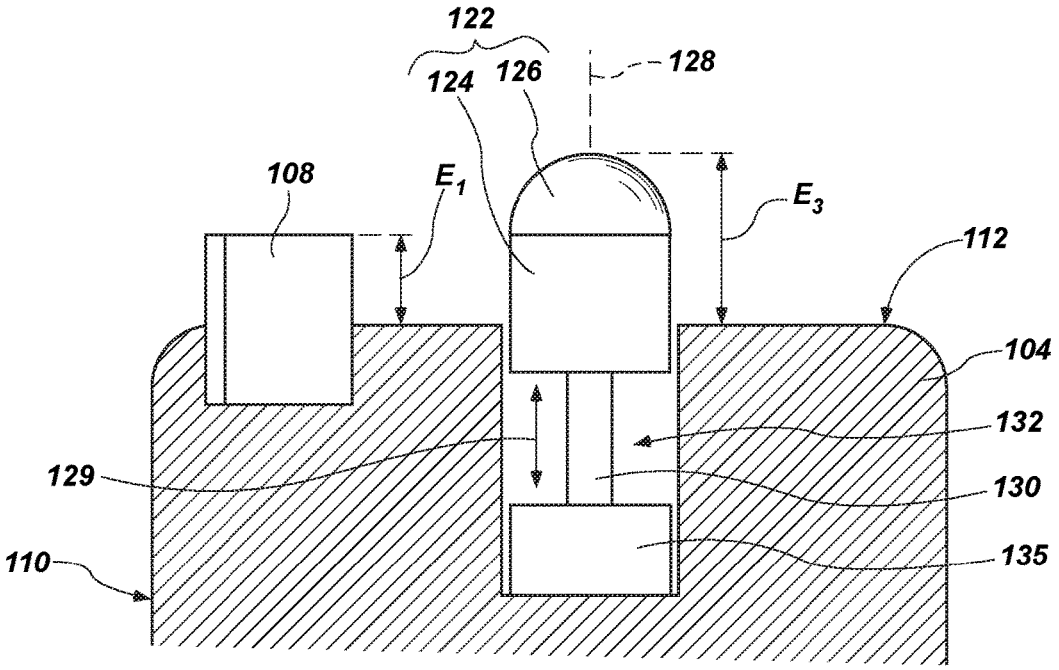
FIG. 3 is a simplified cross-sectional view of the blade of FIG. 1 illustrating a cutting element in an extended position.

FIG. 3 is a simplified cross-sectional view of the blade 104 of FIG. 2. The selectively actuatable cutting element 122 shown in FIG. 3 may be in a second, post-actuation, extended state. When the selectively actuatable cutting element 122 is in the second state, the selectively actuatable cutting element 122 may engage with an underlying earth formation and may specifically perform at least one of a gouging or crushing cutting action at least upon first contact with the earth formation. For example, the selectively actuatable cutting element 122 may be exposed to the same extent as, or overexposed relative to, other cutting elements of the earth-boring tool 100, such as the shearing cutting element 108 shown in FIG. 3. More specifically, the maximum exposure $E_1$ of the shearing cutting element 108 above the face 112 of the blade 104 may be less than or equal to a maximum extended exposure $E_3$ of the selectively actuatable cutting element 122 above the face 112. As a specific, nonlimiting example, a difference between the maximum exposure $E_1$ of the shearing cutting element 108 above the face 112 and the maximum extended exposure $E_3$ of the selectively actuatable cutting element 122 above the face 112 may be greater than a depth of cut of the selectively actuatable cutting element 122 (i.e., greater than a depth of penetration of the selectively actuatable cutting element 122 into the underlying earth formation). The maximum exposure $E_1$ of the shearing cutting element 108 above the face 112 of the blade 104 may be, for example, about equal to or less than a maximum extended exposure $E_3$ of the selectively actuatable cutting element 122 above the face 112. More specifically, the maximum exposure $E_1$ of the shearing cutting element 108 above the face 112 of the blade 104 may be, for example, about 0.05 in or more less than a maximum extended exposure $E_3$ of the selectively actuatable cutting element 122 above the face 112. As a specific, nonlimiting example, the maximum exposure $E_1$ of the shearing cutting element 108 above the face 112 of the blade 104 may be, for example, about 0.1 in or more less than a maximum extended exposure $E_3$ of the selectively actuatable cutting element 122 above the face 112.

The selectively actuatable cutting element 122 may perform at least one of a gouging or crushing cutting action because of a shape of the selectively actuatable cutting element 122, a force of impact upon actuation of the selectively actuatable cutting element 122, or both. For example, the selectively actuatable cutting element 122 may be shaped to perform at least one of a gouging or crushing cutting action both upon initial actuation of the selectively actuatable cutting element 122 and for a complete duration of time while the selectively actuatable cutting element 122 remains in the second, extended state shown in FIG. 3. The selectively actuatable cutting element 122 may include, for example, a substrate 124 of a hard material (e.g., metal-matrix-cemented tungsten carbide) positioned proximate the blade 104 and a superhard, polycrystalline material 126 (e.g., polycrystalline diamond) positioned to engage the earth formation. The superhard, polycrystalline material 126 may exhibit, for example, a nonplanar (e.g., a blunt) shape to cause the superhard, polycrystalline material 126 to gouge and crush the underlying earth formation, rather than shearing the earth formation. As a specific, nonlimiting example, the superhard, polycrystalline material 126 may be hemispherical in shape, and a longitudinal axis 128 of the selectively actuatable cutting element 122 (i.e., an axis extending along a geometrical center of the superhard, polycrystalline material 126 and of a cylindrical substrate 124) may be at least substantially parallel to a direction 129 of movement of the selectively actuatable cutting element 122.

The selectively actuatable cutting element 122 may be movable between the first state shown in FIG. 2 and the second state shown in FIG. 3 by an actuation mechanism 130. The actuation mechanism 130 may be mounted to the body 102 (see FIG. 1) of the earth-boring tool 100 (see FIG. 1), such as, for example, within a pocket 132 formed in the blade 104. The actuation mechanism 130 may be, for example, an electromechanical device, a hydraulic device, or a purely mechanical device configured to cause the selectively actuatable cutting element 122 to extend and retract in response to predetermined inputs. For example, the actuation mechanism 130 shown in FIGS. 2 and 3 may be an electromechanical device including a piston attached to, and configured to move, the selectively actuatable cutting element 122 and a driver 135 configured to cause the piston to move linearly to extend and retract the selectively actuatable cutting element 122 (e.g., using a gearing system). Additional embodiments of the actuation mechanism 130 are discussed in greater detail in connection with FIGS. 10 through 18.

Figure 4:
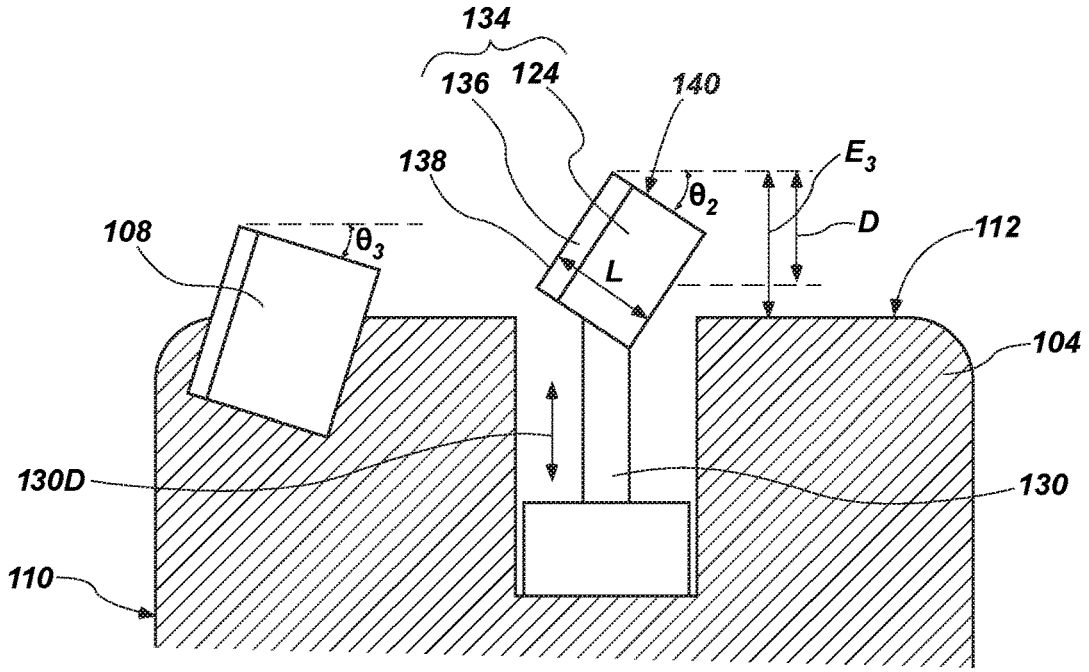
FIG. 4 is a simplified cross-sectional view of another embodiment of a selectively actuatable cutting element mounted to a blade of the earth-boring tool of FIG. 1.

FIG. 4 is a simplified cross-sectional view of another embodiment of a selectively actuatable cutting element 134 mounted to a blade 104 of the earth-boring tool 100 of FIG. 1. In some embodiments, such as that shown in FIG. 4, the selectively actuatable cutting element 134 may be shaped to perform a gouging, cutting action only upon actuation of the selectively actuatable cutting element 134 and initial engagement with the underlying earth formation (e.g., during impact) and to perform a subsequent shearing cutting action by a cutting edge at a periphery of the cutting element 134 while the selectively actuatable cutting element 134 remains in the second, extended state shown in FIG. 4 as earth-boring tool 100 rotates. A superhard, polycrystalline material 136 of such a selectively actuatable cutting element 134 may exhibit, for example, a sharp cutting edge to cause the superhard, polycrystalline material 136 to shear the underlying earth formation, after having performed an initial gouging action on the earth formation. As a specific, nonlimiting example, the superhard, polycrystalline material 136 may include an at least substantially planar cutting face 138 (e.g., a disc of the superhard, polycrystalline material 136) at a rotationally leading end of a cylindrical substrate 124 of the selectively actuatable cutting element 134, and a back rake angle $\theta_2$ of the selectively actuatable cutting element 134 (i.e., an angle at which a side surface 140 of the substrate 124 of the selectively actuatable cutting element 134 is oriented with respect to a horizontal direction of rotation) may be different from (e.g., greater than or less than) a back rake angle $\theta_3$ of the shearing cutting element 108. When such geometry for the selectively actuatable cutting element 134 is used, an initial gouging cutting action may be performed by the selectively actuatable cutting element 134 because of the impact from forcefully extending the selectively actuatable cutting element 134 utilizing the actuation mechanism 130. However, in many instances it may be desirable to withdraw the earth-boring tool 100 (FIG. 1) from contact with the underlying formation before extending selectively actuatable cutting element 134 to avoid impact damage to the superhard, polycrystalline material 136 of a cutting edge of the selectively actuatable cutting element 134.

A peak force exerted by the selectively actuatable cutting element 134 on the underlying earth formation upon initial extension and contact with the earth formation may be, for example, about 30% of a weight applied to the drill string (e.g., weight on bit (WOB)) or less. Of course, a total force exerted by the selectively actuatable cutting element 134 may include the applied weight, such that the total force exerted by the selectively actuatable cutting element 134 may be, for example, about 130% of the applied weight or less. More specifically, the peak force exerted by the selectively actuatable cutting element 134 on the underlying earth formation upon initial extension and contact with the earth formation may be, for example, about 20% of the weight applied to the drill string or less (for a total force of about 120% of the applied weight or less). As specific, nonlimiting examples, the peak force exerted by the selectively actuatable cutting element 134 on the underlying earth formation upon initial extension and contact with the earth formation may be, for example, about 15% (total force of about 115%), about 12.5% (total force of about 112.5%), or about 10% (total force of about 110%) of the weight applied to the drill string or less.

In some embodiments, an extension distance D of the selectively actuatable cutting element 134 may be at least substantially constant from actuation to actuation. In other embodiments, the extension distance D of the selectively actuatable cutting element 134 may change over time. For example, the extension distance D of the selectively actuatable cutting element 134 may alternate between a larger maximum extension distance and a smaller maximum extension distance D to cause the selectively actuatable cutting element 134 to perform a first, hard impact and a subsequent, softer impact and then repeat such impacts in a cycle. As another example, the extension distance D may gradually decrease over time. More specifically, a decrement amount by which the extension distance D decreases for each subsequent actuation may be at least substantially equal to an expected depth of material removal from the superhard-polycrystalline material 136, such that a maximum extended exposure $E_3$ of the selectively actuatable cutting element 134 may remain at least substantially constant despite wear of an engaging portion of the selectively actuatable cutting element 134.

In some embodiments, the change in extension distance D of the selectively actuatable cutting element 134 may replenish the cutting portion of the selectively actuatable cutting element 134, prolonging its useful life. For example, the selectively actuatable cutting element 134 may exhibit an extended longitudinal length L, and the longitudinal length L may be at least substantially parallel to a direction 130D of extension of the selectively actuatable cutting element 134 (see, e.g., FIGS. 2, 3). In such a configuration, the extension distance D may gradually increase over time. For example, the extension distance D may increase by an amount at least substantially equal to an expected wear amount for each actuation, or a total accrued actuated time, of the selectively actuatable cutting element 134.

Figure 5:
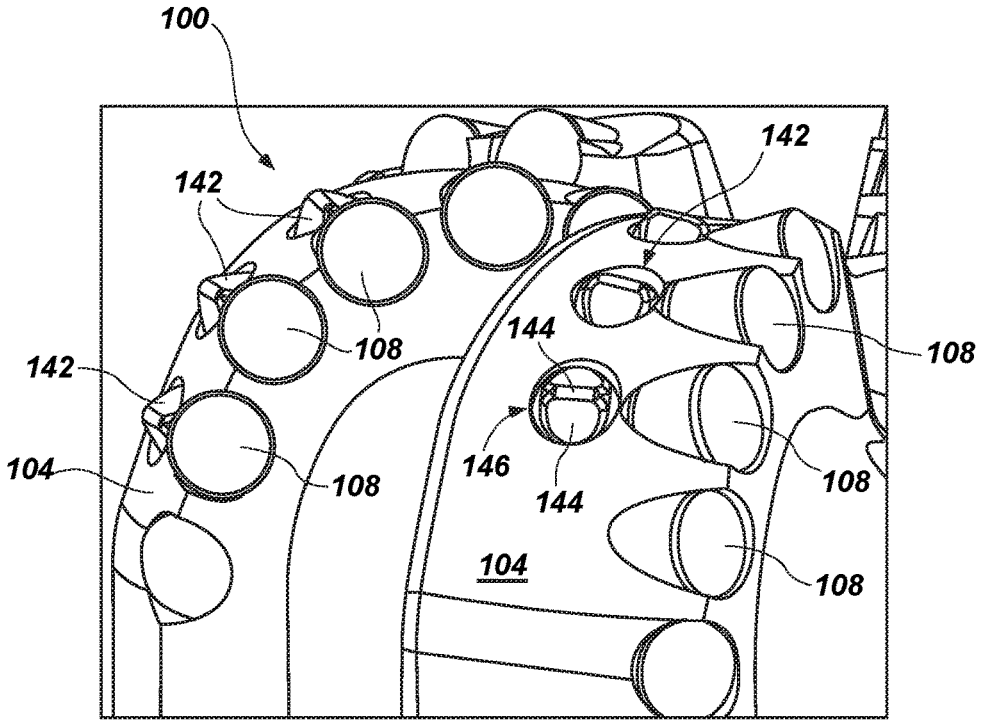
FIG. 5 is a perspective view of an earth-boring tool including another embodiment of a selectively actuatable cutting element.

FIG. 5 is a perspective view of an earth-boring tool 100 including another embodiment of a selectively actuatable cutting element 142. In some embodiments, such as that shown in FIG. 5, multiple selectively actuatable cutting elements 142 may be mounted to, and extendable from, a single blade 104. The selectively actuatable cutting elements 142 may exhibit a chisel shape. For example, the selectively actuatable cutting elements 142 may include sloping surfaces 144 at opposing lateral sides (i.e., on two opposite sides divided by a line tangent to a direction of rotation) of the selectively actuatable cutting elements 142 that may extend out from the blade 104 to an apex surface 146. While specific shapes have been depicted and described in connection with FIGS. 2 through 5, selectively actuatable cutting elements in accordance with this disclosure may exhibit any desirable shape, so long as they perform at least one of a gouging or crushing cutting action upon actuation of the selectively actuatable cutting elements. For example, selectively actuatable cutting elements may exhibit pointed, tombstone, pyramidal, cylindrical, chamfered, and other geometric shapes.

In some embodiments, such as that shown in FIG. 5, a material of the selectively actuatable cutting elements 142 may be a ceramic-metallic composite material (i.e., a cermet). For example, the material of the selectively actuatable cutting element 142 may be a metal-matrix-cemented tungsten carbide or a superhard-material-impregnated, metal-matrix-cemented tungsten carbide. More specifically, the material of the selectively actuatable cutting element 142 may include diamond-impregnated, metal-matrix-cemented tungsten carbide. Such selectively actuatable cutting elements 142 may lack a discrete tablet, disc, dome, or other concentrated mass of superhard, polycrystalline material. For example, selectively actuatable cutting elements lacking a concentrated mass of superhard, polycrystalline material may be shaped and configured in a manner similar to any of the selectively actuatable cutting elements shown and described in connection with FIGS. 1 through 4, with the superhard, polycrystalline material being replaced by, for example, additional ceramic-metallic composite material.

Figure 6:
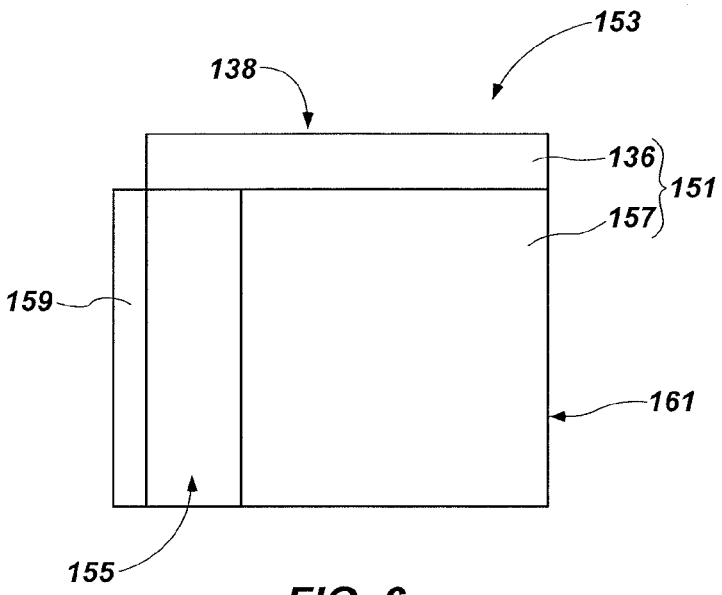
FIG. 6 is a side view of another embodiment of a selectively actuatable cutting element.
Figure 7:
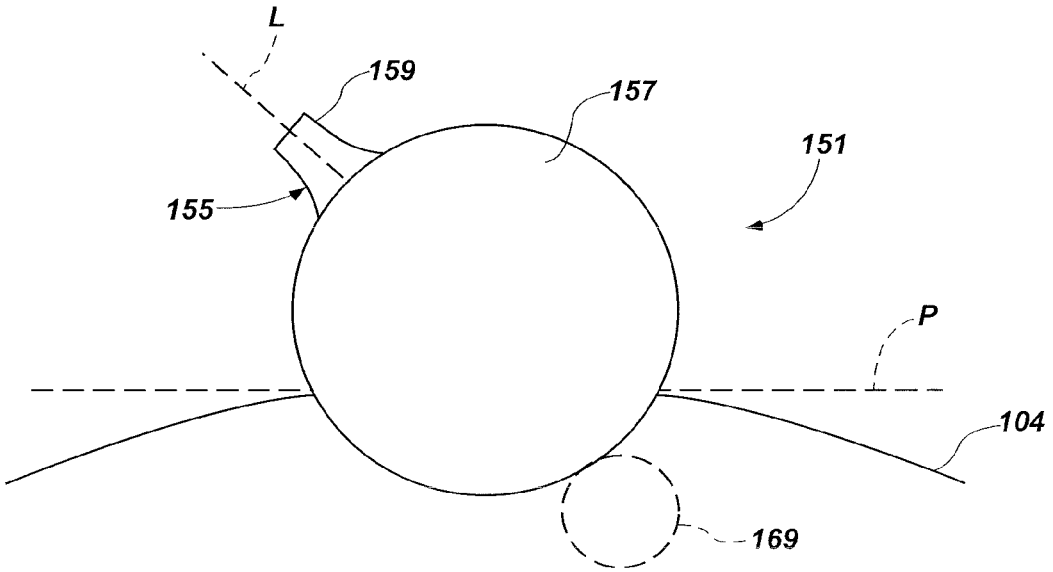
FIG. 7 is a rear view of the selectively actuatable cutting element of FIG. 6.

FIG. 6 is a side view of another embodiment of a selectively actuatable cutting element 151, and FIG. 7 is a rear view of the selectively actuatable cutting element 151 of FIG. 6. With collective reference to FIGS. 6 and 7, the selectively actuatable cutting element 151 may include a shearing portion 153 and a gouging and/or crushing portion 155. More specifically, the shearing portion 153 may be configured at least substantially the same as the selectively actuatable cutting element 134 of FIG. 4, including a concentrated mass of superhard, polycrystalline material 136 secured to a substrate 157, the superhard, polycrystalline material 136 presenting an at least substantially planar cutting face 138. The gouging and/or crushing portion 155 may include, for example, a shaped extension 159 extending radially outward from a lateral sidewall 161 of the substrate 157. The shaped extension 159 may exhibit, for example, a domed, hemispherical, conical, chisel, or other shape configured to perform a crushing and/or gouging cutting action on an underlying earth formation. Such a selectively actuatable cutting element 151 may be positioned proximate a rotationally leading surface of a corresponding blade 104, in a manner similar to the selectively actuatable cutting elements 122 shown in FIG. 8.

Actuation of the selectively actuatable cutting element 151 may at least partially involve rotation of the selectively actuatable cutting element 151. For example, the selectively actuatable cutting element 151 may rotate from a first position in which a line L passing through a geometrical center of the gouging and/or crushing portion 155 is at an oblique angle relative to a plane P tangent to the surface of the blade 104 proximate the selectively actuatable cutting element 151 to a second position in which the line L is at least substantially perpendicular to such plane. The gouging and/or crushing portion 155 may then face the underlying earth formation. Rotation of the selectively actuatable cutting element 151 may be accomplished by a rotating mechanism 169, which may be in accordance with any of the systems for rotating cutting elements disclosed in U.S. Patent App. Pub. No. 2014/0318873, published Oct. 30, 2014, to Patel et al., or U.S. Patent App. Pub. No. 2012/0273281, published Nov. 1, 2012, to Burhan et al., the disclosure of each of which is incorporated herein in its entirety by this reference. In some embodiments, rotation alone may cause the gouging and/or crushing portion 155 to engage with the underlying earth formation. In other embodiments, the selectively actuatable cutting element 151 may also move linearly to achieve actuation, such as, for example, after rotation and then in a manner similar to that shown in FIGS. 2 through 4. After rotating, and optionally linearly extending, to engage an underlying earth formation, the selectively actuatable cutting element 151 may rotate again to return to the first position, and optionally retract linearly after such rotation. Such rotation may propagate cracks initiated by the selectively actuatable cutting element 151, which may further facilitate the removal of the underlying earth formation.

Figure 8:
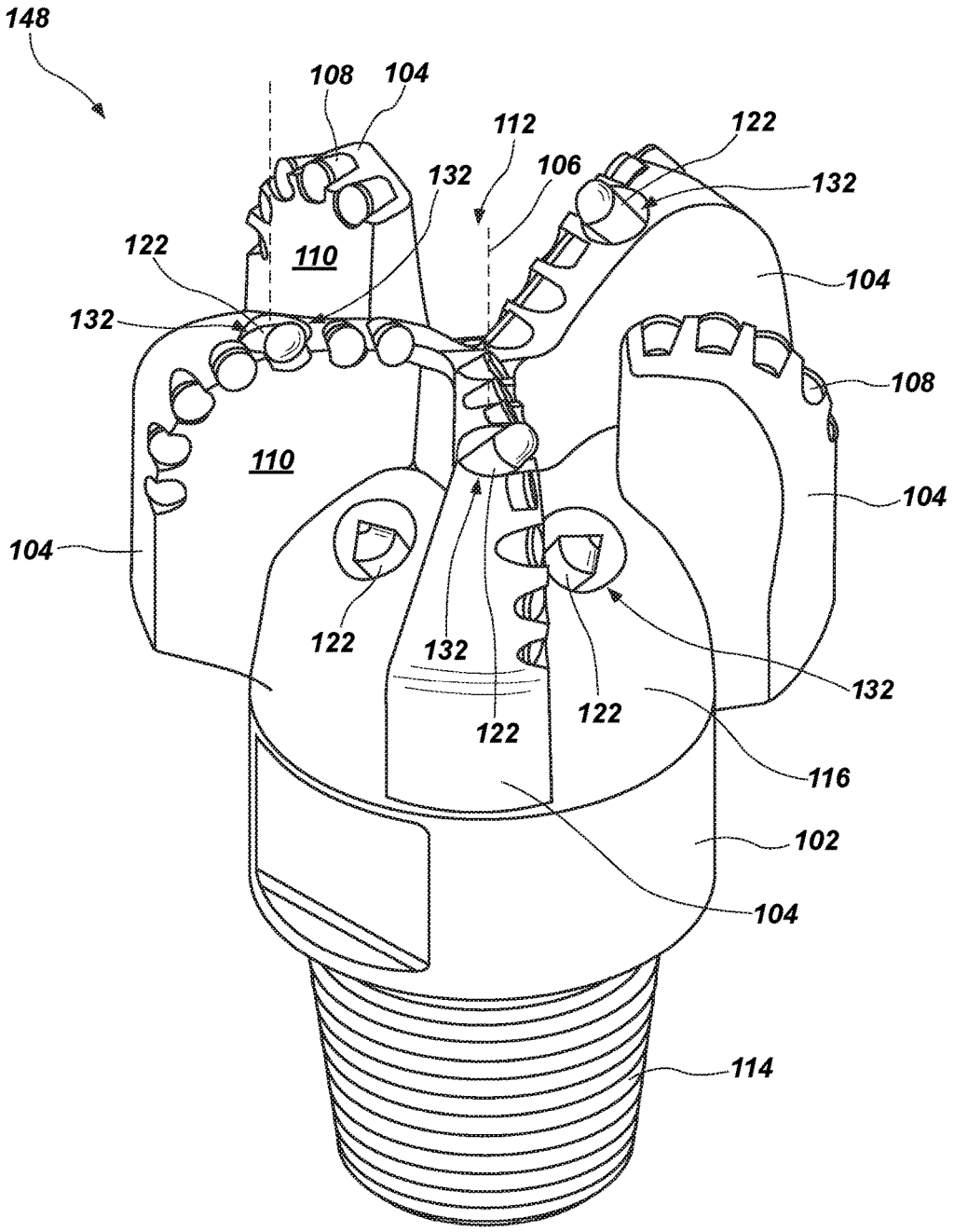
FIG. 8 is a perspective view of another embodiment of an earth-boring tool including alternative placement of a selectively actuatable cutting element.

FIG. 8 is a perspective view of another embodiment of an earth-boring tool 148. In some embodiments, such as that shown in FIG. 8, the selectively actuatable cutting elements 122 may be positioned in locations on the earth-boring tool 148 other than rotationally trailing portions of blades 104 behind other, primary, shearing cutting elements 108. For example, a selectively actuatable cutting element 122 may be located proximate the rotationally leading surface 110 of a blade 104, such as, for example, between two adjacent shearing cutting elements 108. More specifically, a portion of the selectively actuatable cutting element 122 may be located within a pocket 132 extending into the blade 104 proximate the rotationally leading surface 110 and another portion of the selectively actuatable cutting element 122 may extend rotationally forward beyond the rotationally leading surface 110 of the blade 104. As another example, a selectively actuatable cutting element 122 may be located in a junk slot 116 between blades 104. More specifically, the selectively actuatable cutting element 122 may be mounted to the body 102 of the earth-boring tool 148 within a pocket 132 extending into the body 102 between the blades 104 and may be extendable from the junk slot 116 to engage with an earth formation. As still other examples, selectively actuatable cutting elements 122 may be located on the body 102 proximate the shank 114, on rotationally leading surfaces 110 or rotationally trailing surfaces of the blades 104, or on other locations on the earth-boring tool 148.

Figure 9:
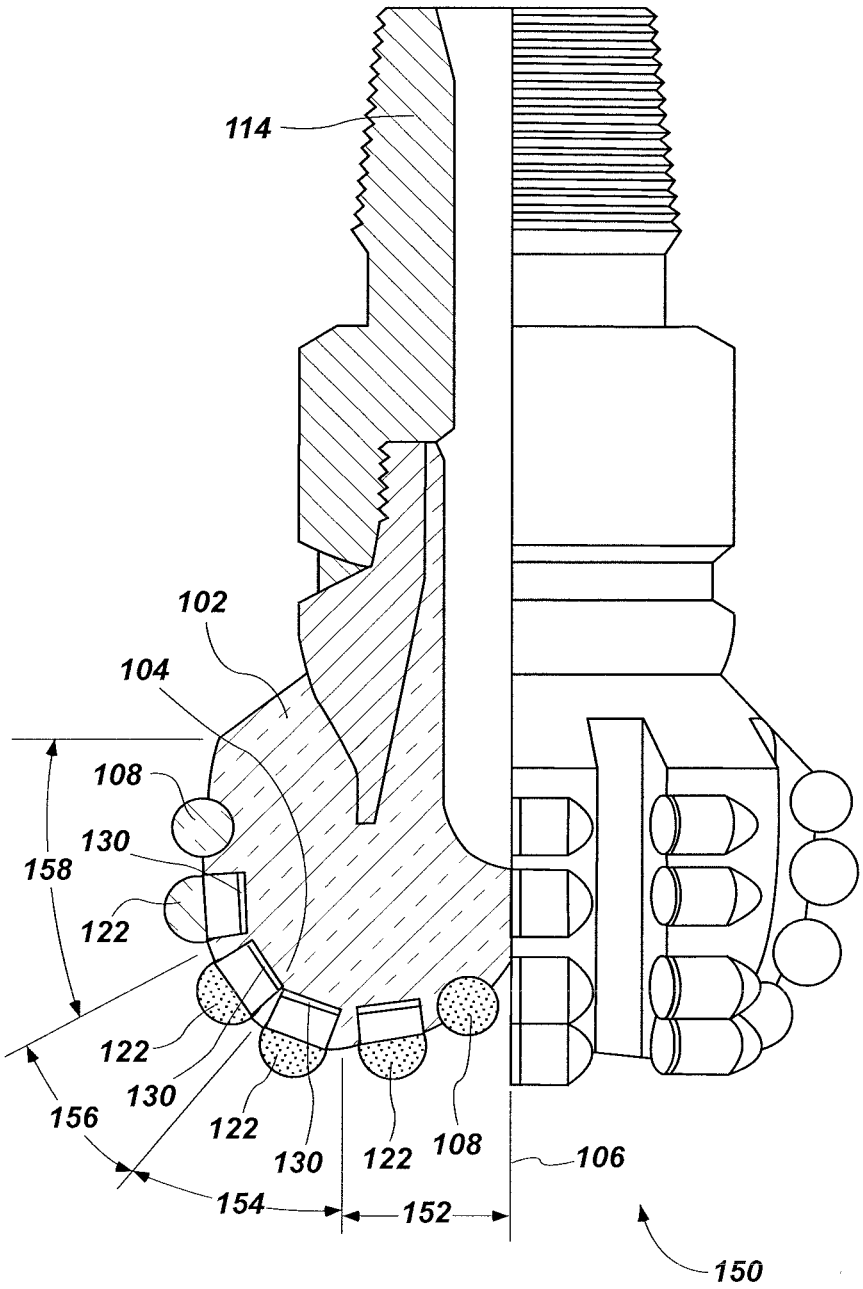
FIG. 9 is a simplified, partial cross-sectional view of still another embodiment of an earth-boring tool utilizing other alternative placements for selectively actuatable cutting elements.

FIG. 9 is a simplified, partial cross-sectional view illustrating an embodiment of an earth-boring tool 150 utilizing selective placement of the selectively actuatable cutting elements 122 of the present disclosure. For illustrative purposes, the earth-boring tool of FIG. 9 is a fixed-cutter rotary drill bit similar to that shown in FIG. 1, although the selective placement embodiments disclosed herein may be incorporated on other earth-boring tools, such as reamers, hole-openers, casing bits, core bits, or other earth-boring tools.

As shown in FIG. 9, a profile of an earth-boring tool 150 may include a cone region 152 proximate the longitudinal axis 106, a nose region 154 radially outward from, and adjacent to, the cone region 152, a shoulder region 156 radially outward from, and adjacent to, the nose region 154, and a gage region 158 at a radially outermost position of the earth-boring tool 150. The cone region 152 may be characterized by a sloping surface extending longitudinally away from the shank 114 and radially outward from the longitudinal axis 106. The nose region 154 may be characterized by a gradual change in slope back toward the shank 114 and radially outward from the longitudinal axis 106. The shoulder region 156 may be characterized may a curving surface extending toward the shank 114. Finally, the gage region 158 may be characterized by, for example, a surface extending at least substantially parallel to the longitudinal axis 106 from the shoulder region 156 toward the shank 114.

Selectively actuatable cutting elements 122 in accordance with this disclosure may be located in one or more of the cone, nose, shoulder, and gage regions 152 through 158. For example, selectively actuatable cutting elements 122 may be located only in the nose and shoulder regions 154 and 156, where a work rate for cutting elements is greatest, in some embodiments. As another example, selectively actuatable cutting elements 122 may be located in each of the cone, nose, shoulder, and gage regions 152 through 158.

With collective reference to FIGS. 8 and 9, only some of the selectively actuatable cutting elements 122 may be actuated at any given time in some embodiments. For example, selectively actuatable cutting elements 122 on one blade 104 or multiple blades 104 may be actuated, while selectively actuatable cutting elements 122 on at least one other blade 104 may remain in a retracted state. As another example, selectively actuatable cutting elements 122 in one region 152 through 158 or multiple regions 152 through 158 may be actuated, while selectively actuatable cutting elements 122 in at least one other region 152 through 158 may remain in the retracted state. Such locationally selective actuation may enable the selectively actuatable cutting elements 122 to engage an underlying earth formation, for example, on only one lateral side of the earth-boring tool 148 or 150 or in only a portion of the regions 152 through 158. In other embodiments, all the selectively actuatable cutting elements 122 may be simultaneously actuated. Like actuation, subsequent retraction of the selectively actuatable cutting elements 122 may be simultaneous or selective based on location.

In some embodiments, actuation and retraction of the selectively actuatable cutting elements 122 may be periodic. For example, the selectively actuatable cutting elements 122 may be cycled between the extended and retracted states to alternate between a periodic gouging and\or crushing cutting action and subsequent non-engagement with the earth formation. More specifically, the selectively actuatable cutting elements 122 may be cycled between the extended and retracted states as quickly as the actuation mechanism 130 may enable. As specific, nonlimiting examples, the selectively actuatable cutting elements 122 may be cycled between the extended and retracted states at least once per second, twice per second, or three times per second. As another example, the selectively actuatable cutting elements 122 may pause at an apex, a nadir, or at some location therebetween when cycling between the extended and retracted states. More specifically, the selectively actuatable cutting elements 122 may be actuated and, for example, remain actuated for an extended period of time to engage in an initial gouging and\or crushing cutting action and continue with an extended gouging and\or crushing cutting action or perform a subsequent shearing cutting action. As another more specific example, the selectively actuatable cutting elements 122 may be actuated and, for example, subsequently retracted for an extended period of time to engage in an initial gouging and\or crushing cutting action and then cease engagement with the earth formation for an extended period. The extended period may be, for example, at least one minute, at least five minutes, at least one hour, or any other desired period of time. As yet another example, the selectively actuatable cutting elements 122 may alternate between continuous extension and retraction and intermittent extension and retraction.

Figure 10:
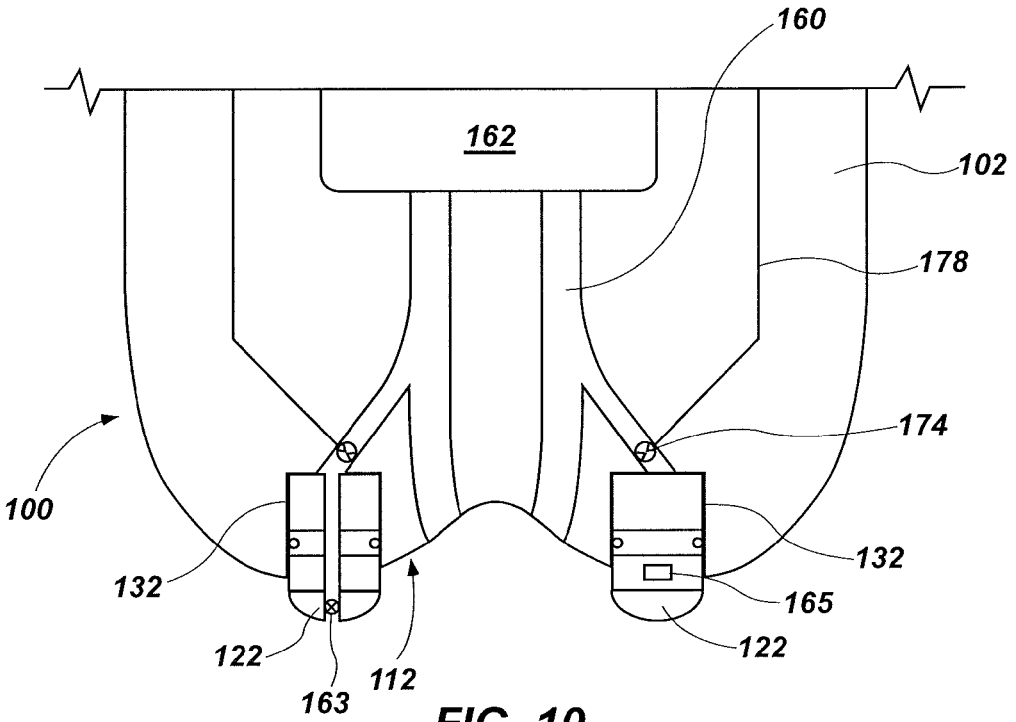
FIG. 10 is a schematic view of a portion of the earth-boring tool of FIG. 1, showing fluid channels extending therethrough with selectively actuatable cutting elements in an extended state.
Figure 11:
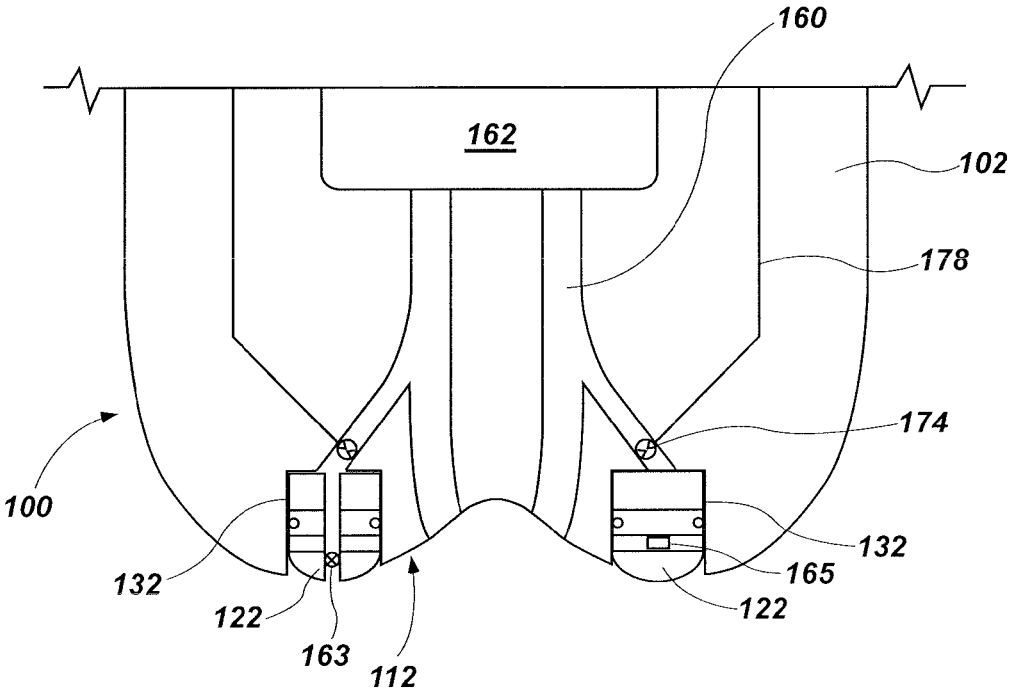
FIG. 11 is a schematic view of the portion of the earth-boring tool of FIG. 10, with the selectively actuatable cutting elements in a retracted state.

FIG. 10 is a schematic view of a portion of the earth-boring tool 100 of FIG. 1, showing fluid channels 160 extending therethrough with selectively actuatable cutting elements 122 in an extended state, and FIG. 11 is a schematic view of the portion of the earth-boring tool 100 of FIG. 10, with the selectively actuatable cutting elements 122 in a retracted state. As shown in FIGS. 10 and 11, the body 102 of the earth-boring tool 100 may include fluid channels 160 within the body 102, which may extend from a central fluid channel 162 to the nozzles inserts 120 (see FIG. 1) and to pockets 132 in the body 102 containing the selectively actuatable cutting elements 122. The central fluid channel 162 may extend to the exterior of the earth-boring tool 100 through an opening in the shank 114 (see FIG. 1) for connection enabling fluid communication along a drill string.

In some embodiments, one or more of the selectively actuatable cutting elements 122 may include a hydraulic fracture device configured to initiate cracks and/or propagate cracks initiated by the selectively actuatable cutting elements 122, softening the formation and facilitating its removal. For example, one or more of the selectively actuatable cutting elements 122 may include a selectively actuatable nozzle 163. In some embodiments, the selectively actuatable nozzle 163 may be in fluid communication with the fluid channels 160 and configured to direct a jet of fluid (e.g., drilling fluid, hydraulic fluid, etc.) from the fluid channels 160 toward the earth formation. In other embodiments, the selectively actuatable nozzle 163 may be in fluid communication with a reservoir 310 (see FIG. 12) of fluid that may be forced from the reservoir 310 (see FIG. 12), through the selectively actuatable nozzle 163, toward the earth formation. The nozzle 163 may be directed at a portion of the earth formation rotationally leading or rotationally following the selectively actuatable cutting element 122. In addition, the nozzle 163 may be directed at a portion of the earth formation rotationally leading or rotationally following an associated shearing cutting element 108 (see FIG. 2).

Concurrently when the selectively actuatable cutting element 122 is actuated, after actuation of the selectively actuatable cutting element 122, or before actuation of the selectively actuatable cutting element 122, the selectively actuatable nozzle 163 may be activated, causing a jet of the fluid to flow from the fluid channel 160, through the selectively actuatable nozzle 163, toward the earth formation. The fluid may impact the formation and form or propagate cracks therein, facilitating removal of the earth formation. As another example, one or more of the selectively actuatable cutting elements 122 may include a selectively activatable ultrasonic vibrator 165 secured to the selectively actuatable cutting element 122 and configured to ultrasonically vibrate the selectively actuatable cutting element 122. When the selectively actuatable cutting element 122 is actuated, or after actuation of the selectively actuatable cutting element 122, the selectively activatable ultrasonic vibrator 165 may be activated, causing the selectively actuatable cutting element 122 to vibrate against the earth formation, directing an ultrasonic wave thereto. Vibration of the selectively actuatable cutting element 122 against the earth formation may propagate cracks therein, facilitating removal of the earth formation.

The selectively actuatable nozzle 163 may be smaller, may cause fluid to exit at higher pressures, and may be located closer to the earth formation when activated than the nozzle inserts 120 (see FIG. 1) used to clear away cuttings. For example, a diameter of an exit port of the selectively actuatable nozzle 163 may be about two times, about three times, or about four times smaller than a diameter of an exit port of the nozzle inserts 120 (see FIG. 1). More specifically, the diameter of the exit port of the selectively actuatable nozzle 163 may be, for example, about 1 cm or less, about 5 mm or less, or about 1 mm or less. As another example, fluid may exit the selectively actuatable nozzle 163 at a pressure of about 35 times, about 100 times, about 250 times, or about 500 times higher than a pressure at which fluid exits the nozzle inserts 120 (see FIG. 1). More specifically, the pressure at which fluid exits the selectively actuatable nozzle 163 may be, for example, about 15,000 psi or more, about 20,000 psi or more, or about 40,000 psi or more. As yet another example, a distance between the selectively actuatable nozzle 163 and the earth formation when in an activated state may be about 10 times, about 20 times, or about 25 times smaller than a distance between the nozzle inserts 120 and the earth formation. More specifically, the distance between the selectively actuatable nozzle 163 and the earth formation when in an activated state may be about 1 cm or less, about 5 mm or less, or about 0 mm (e.g., at least a portion of the selectively actuatable nozzle may be in contact with the earth formation).

Figure 12:
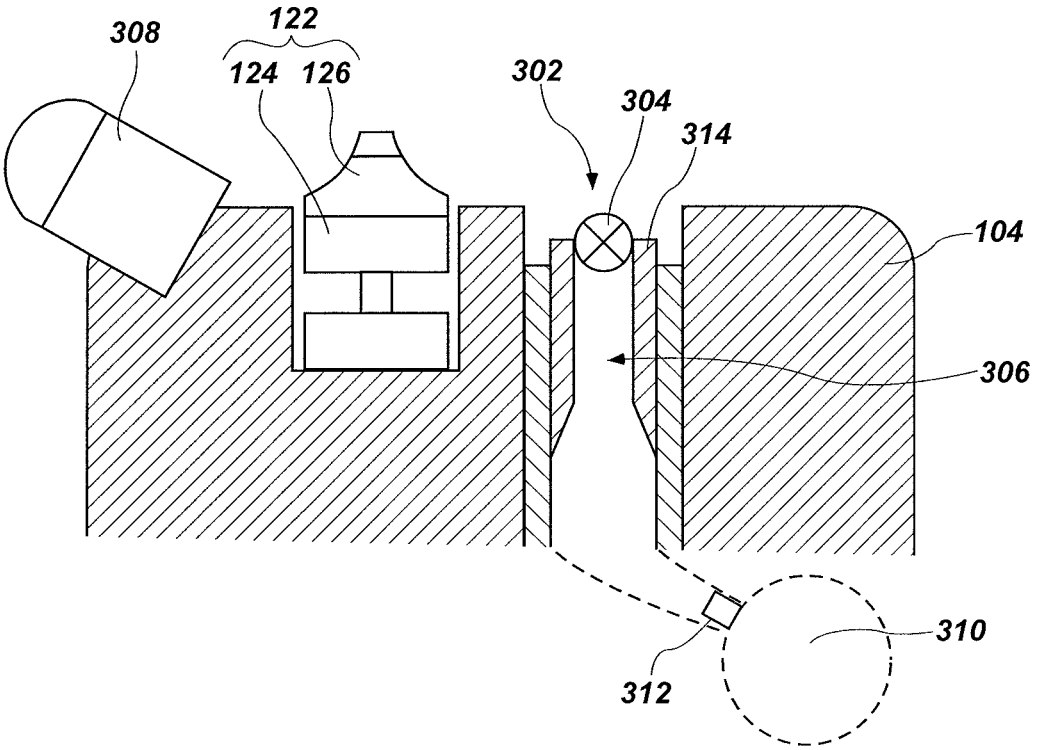
FIG. 12 is a simplified cross-sectional view of an embodiment of a hydraulic fracture device mounted to a blade of an earth-boring tool.

FIG. 12 is a simplified cross-sectional view of another embodiment of a hydraulic fracture device 302 mounted to a blade of an earth-boring tool. In some embodiments, hydraulic fracture devices 302, as shown in FIG. 12, separate from the selectively actuatable cutting elements 122 may be secured to the earth-boring tool 100 (see FIG. 1). In some embodiments, earth-boring tools 100 (see FIG. 1) may lack selectively actuatable cutting elements 122 configured to gouge and/or crush the underlying formation, but may include fixed gouging/crushing cutting elements 308 and hydraulic fracturing devices 302. In other words, the hydraulic fracture devices 302 may be secured to the earth-boring tool 100 (see FIG. 1) instead of, or in addition to, the selectively actuatable cutting elements 122. The fixed gouging/crushing cutting elements 308 may be secured to the blades 104 instead of, or in addition to, the shearing cutting elements 108 (see FIG. 1), and in any of the locations described previously in connection with the shearing cutting elements 108 (see FIG. 1), but may present a nonplanar cutting face configured to gouge and/or crush an underlying earth formation. The hydraulic fracture devices 302 may be positioned on the earth-boring tool 100 at any of the locations described previously for selectively actuatable cutting elements 122, 134, 142, and 151. The hydraulic fracture devices 302 may be configured to initiate cracks and/or propagate cracks initiated by the selectively actuatable cutting elements 122, the shearing cutting elements 108, the fixed gouging/crushing cutting elements 308, or any combination of these.

The hydraulic fracture devices 302 may include, for example, a selectively activatable nozzle 304 in fluid communication with a fluid channel 306 extending from a reservoir 310 located within the body 102 of the earth-boring tool 100 (see FIG. 1), through the body 102 (see FIG. 1), to the location of the selectively activatable nozzle 304, such as, for example, proximate an outer surface of a blade 104. The selectively activatable nozzle 304 may be configured to direct a jet of fluid (e.g., drilling fluid, hydraulic fluid, etc.) toward the earth formation. The selectively activatable nozzle 304 may be directed at a portion of the earth formation rotationally leading or rotationally following a corresponding selectively actuatable cutting element 122 or fixed gouging/crushing cutting element 308. In addition, the selectively activatable nozzle 304 may be directed at a portion of the earth formation rotationally leading or rotationally following an associated shearing cutting element 108 (see FIG. 1). The selectively activatable nozzle 304 may be activated, for example, by opening the selectively activatable nozzle 304 and/or activating a fluid forcing device 312 (e.g., a pump), causing a jet of the fluid to flow from the reservoir 310, through the fluid channel 306 and through the selectively activatable nozzle 304, toward the earth formation. The fluid in the reservoir 310 may be, for example, fracking fluid, magneto-restrictive fluid, or any other fluid that may impact an earth formation to form and/or propagate cracks therein. The fluid may impact the formation and form and/or propagate cracks therein, facilitating removal of the earth formation. In some embodiments, a pressure of the fluid impacting the earth formation may be sufficient to crush and/or gouge the earth formation. After the hydraulic fracture device 302 has initiated and/or propagated cracks in the earth formation to weaken it, the shearing cutting elements 108 may more easily remove the earth formation, enabling reduced wear and erosion on the shearing cutting elements 108 and increased rate of penetration. Activation and deactivation of the selectively activatable nozzle 304 may be accomplished by performing any of the actions described in connection with the valve 174 and nozzle 163 shown in FIGS. 10 and 11.

In some embodiments, the hydraulic fracture devices 302 may be extensible in the same manner as described in this disclosure with respect to selectively actuatable cutting elements 122, 134, 142, and 151. When the hydraulic fracture device 302 is extended, the selectively activatable nozzle 304 may be located proximate the earth formation. More specifically, the selectively activatable nozzle 304 may contact the earth formation without gouging and/or crushing the earth formation when the hydraulic fracture device 302 is extended. For example, the selectively activatable nozzle 304 may be secured to an extensible member 314 configured to extend outward from the blade 104 and retract back toward the blade 104 in any of the ways described previously in connection with the extension and retraction of the selectively actuatable cutting elements 122, 134, 142, and 151, although extension and retraction of the extensible member 314 may not result in gouging and/or crushing the underlying earth formation as a result of contact between the selectively activatable nozzle 304 and the earth formation.

In some embodiments, only one or some hydraulic fracture devices 302 mounted on an earth-boring tool may be activated into an activated state in which fluid flows outward from the hydraulic fracture device 302 and the hydraulic fracture device 302 is optionally extended toward the earth formation, while the remaining hydraulic fracture devices 302 mounted to the earth-boring tool may remain in a deactivated state in which no fluid flows outward from the hydraulic fracture devices 302 and the hydraulic fracture devices 302 optionally remain in a retracted state, in any of the specific locations, patterns, or functional groups discussed in this disclosure in connection with the selectively actuatable cutting elements 122, 134, 142, and 151. In other examples, all of the hydraulic fracture devices 302 on a given earth-boring tool may be concurrently activated and deactivated. As another example, the hydraulic fracture device 302 may be periodically activated and deactivated to repeatedly direct successive jets of fluid at the earth formation. As yet another example, the hydraulic fracture device 302 may remain in an activated state for an extended period of time after being activated to continuously direct a jet of fluid at the earth formation. As a still further example, activation and deactivation of the hydraulic fracture device 302 may occur in response to operator control or any of the environmental or operational triggers discussed in this disclosure in connection with the selectively actuatable cutting elements 122, 134, 142, and 151.

Figure 13:
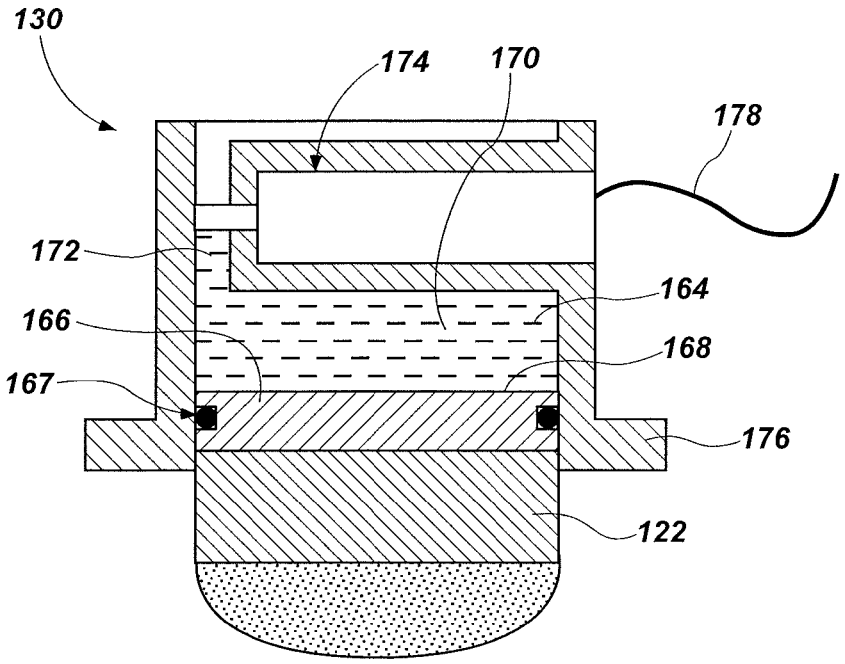
FIG. 13 is a schematic view of an actuation mechanism for a selectively actuatable cutting element for use in an earth-boring tool, the selectively actuatable cutting element shown in an extended state.
Figure 14:
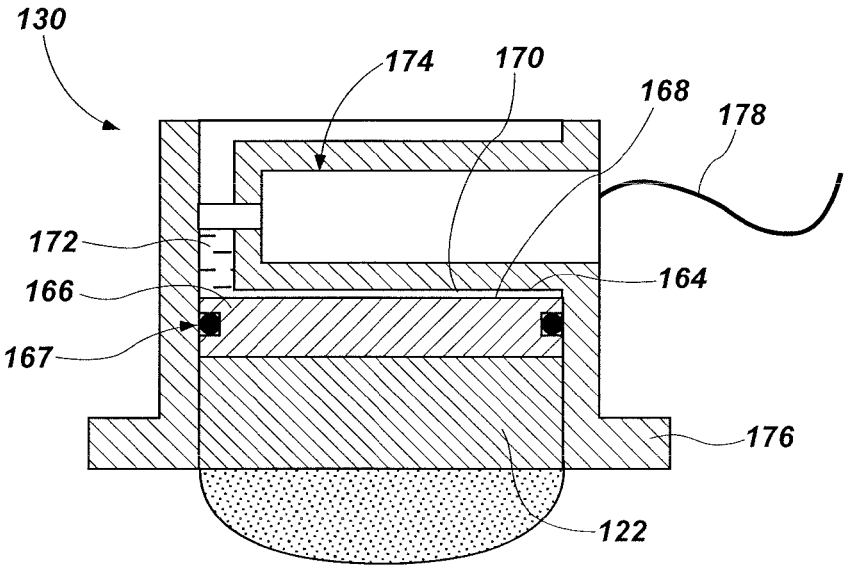
FIG. 14 is a schematic view of the actuation mechanism of FIG. 13 with the selectively actuatable cutting element shown in a retracted state.

FIG. 13 is a schematic view of an actuation mechanism 130 for a selectively actuatable cutting element 122 for use in an earth-boring tool 100, the selectively actuatable cutting element 122 shown in an extended state, and FIG. 14 is a schematic view of the actuation mechanism 130 of FIG. 13 with the selectively actuatable cutting element 122 shown in a retracted state. As shown in FIGS. 13 and 14, an actuation mechanism 130 for the selectively actuatable cutting element 122 may include a barrel wall 164 defining a bore, a piston 166 positioned within the bore, a perimeter of the piston 166 sealed against the barrel wall 164. The piston 166 may include a gland fitted with seals 167 to reduce the likelihood that fluid will pass between the sealed perimeter of the piston 166 and the barrel wall 164, and may also be fitted with a bearing or wear ring. The piston 166 may also include the selectively actuatable cutting element 122, which may be coupled to or integrally formed with the piston 166. For example, the selectively actuatable cutting element 122 may be welded or brazed to the piston 166. Upon insertion into the bore, a surface 168 of the piston 166 and the barrel wall 164 may define a fluid reservoir 170. The actuation mechanism 130 may further include an opening 172 to the fluid reservoir 170 and a valve 174 (e.g., a piezo-electric valve, see also FIGS. 10 and 11) located and configured to control the passage of fluid through the opening 172 to the fluid reservoir 170. As the reservoir 170 is defined by the barrel wall 164 and the surface 168 of the piston 166, the reservoir 170 may vary in size, depending upon the position of the piston 166 within the borehole. An at least substantially incompressible fluid may be located within the reservoir 170, contacting the surface 168 of the piston 166. In view of this, upon closure of the opening 172 by the valve 174, the at least substantially incompressible fluid may be contained within the reservoir 170 and the piston 166 may be held in position via hydraulic pressure. Nonlimiting examples of at least substantially incompressible fluids that may be utilized include mineral oil, vegetable oil, silicone oil, and water.

The actuation mechanism 130 may be sized for insertion into the pocket 132 in the body 102 (see FIGS. 10 and 11), and may include a flange 176 to position the actuation mechanism 130 at a predetermined depth within the pocket 132 and may also join the actuation mechanism 130 to the body 102. For example, the flange 176 may be welded to the face 112 of the earth-boring tool 100 (see FIGS. 10 and 11), which may maintain the actuation mechanism 130 at least partially within the pocket 132 in the body 102 and also may provide a fluid-tight seal between the actuation mechanism 130 and the body 102. Additionally, wiring 178 (see FIGS. 10 and 11) may be provided and routed through the bit body 102 to provide electrical communication between the valve 174 and an electronics module 192 (described in further detail in connection with FIG. 19).

Figure 15:
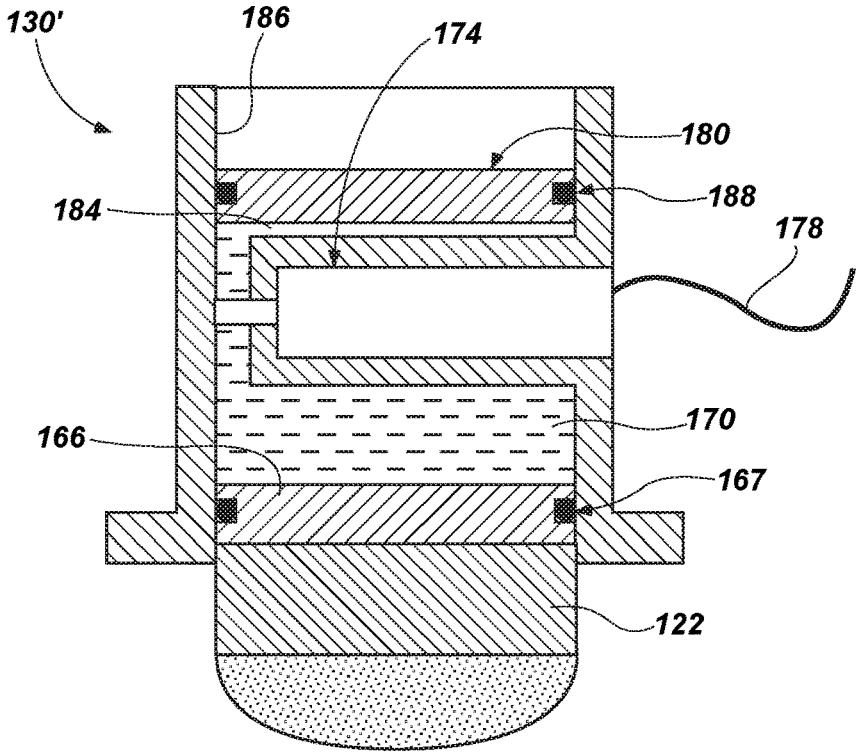
FIG. 15 is a schematic view of another embodiment of an actuation mechanism including a selectively actuatable cutting element, the selectively actuatable cutting element shown in an extended state.
Figure 16:
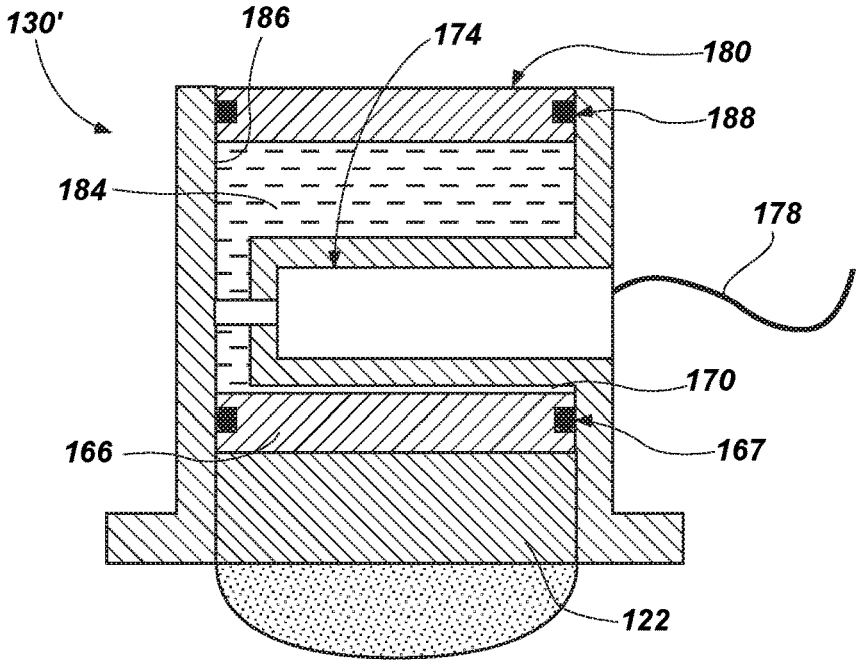
FIG. 16 is a schematic view of the actuation mechanism of FIG. 15 with the selectively actuatable cutting element shown in a retracted state.

FIG. 15 is a schematic view of yet another embodiment of an actuation mechanism 130' including a selectively actuatable cutting element 122, the selectively actuatable cutting element 122 shown in an extended state, and FIG. 16 is a schematic view of the actuation mechanism 130' of FIG. 15 with the selectively actuatable cutting element 122 shown in a retracted state. In some embodiments, the actuation mechanism 130' may include a second piston 180, and a valve 174 positioned between the first and second pistons 166 and 180, respectively, and configured to regulate flow between a first reservoir 170 and a second reservoir 184.

The second piston 180 may be positioned within a second bore defined by a second barrel wall 186, a perimeter of the second piston 180 sealed against the second barrel wall 186. The second piston 180 may also include a seal 188, such as one or more of an O-ring, a quad ring, a square ring, a wiper, a backup ring, and other packing, which may provide a seal between the second piston 180 and the second barrel wall 186.

In some embodiments, such as that shown in FIGS. 15 and 16, the surfaces of the first and second pistons 166 and 180, respectively, exposed to the incompressible fluid and the drilling fluid may have at least substantially similar sizes. In other embodiments, the surface areas of the opposing surfaces of the second piston 180 may be sized differently, so as to provide a pressure multiplier to increase the pressure of the incompressible fluid relative to the pressure applied by the drilling fluid. Additionally, the size and surface areas of the first piston 166 may be different than the size and surface areas of the second piston 180.

Figure 17:
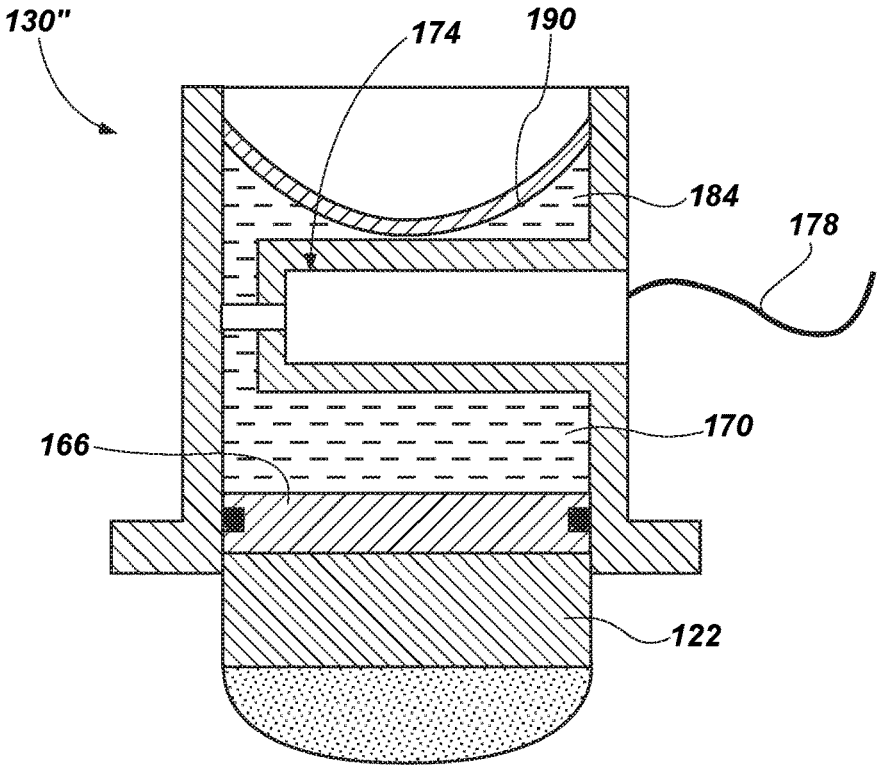
FIG. 17 is a schematic view of still another embodiment of an actuation mechanism for a selectively actuatable cutting element including a diaphragm, the selectively actuatable cutting element shown in an extended state.
Figure 18:
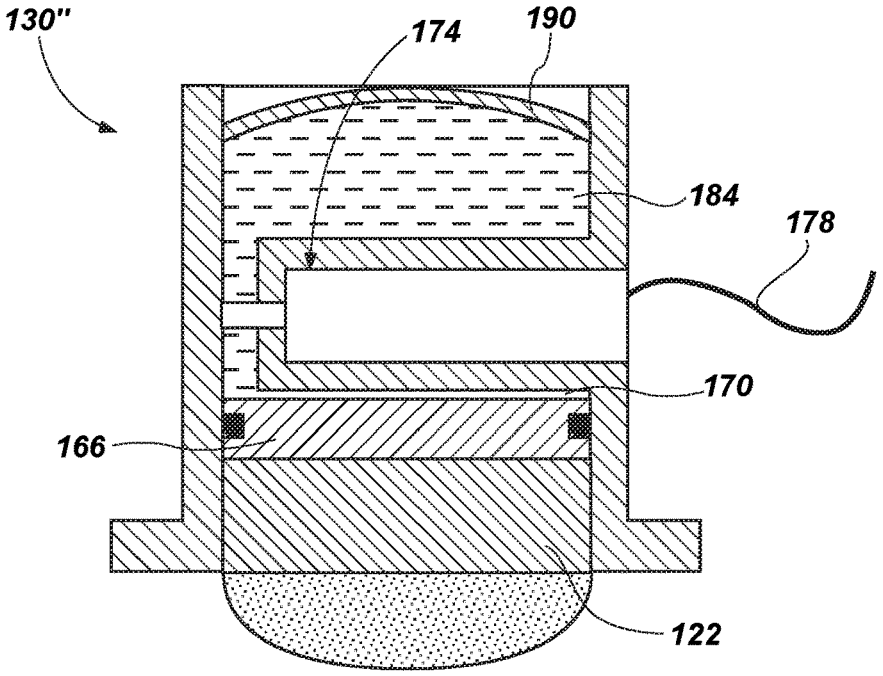
FIG. 18 is a schematic view of the actuation mechanism of FIG. 17 with the selectively actuatable cutting element shown in a retracted state.

FIG. 17 is a schematic view of still another embodiment of an actuation mechanism 130" for a selectively actuatable cutting element 122 including a diaphragm 190, the selectively actuatable cutting element 122 shown in an extended state, and FIG. 18 is a schematic view of the actuation mechanism 130" of FIG. 17 with the selectively actuatable cutting element 122 shown in a retracted state. In some embodiments, such as that shown in FIGS. 17 and 18, the actuation mechanism 130" may include a flexible diaphragm 190 to provide an expandable fluid reservoir 184. For example, an elastomeric member may be positioned over an end of the actuation mechanism 130" and provide a fluid barrier, yet still allow for fluid pressure to be communicated from the drilling fluid within the bit body 102 (see FIGS. 10 and 11) through a valve 174 to a first reservoir 170 behind a piston 166 including a selectively actuatable cutting element 122.

As shown schematically in FIGS. 10 and 11, the fluid channels 160 in the body 102 may connect the central fluid channel 162 of the earth-boring tool 100 to the pocket 132 containing the selectively actuatable cutting element 122. The fluid channels 160 may enable fluid communication between the central fluid channel 162 and the actuation mechanism 130, 130', and 130" (see FIGS. 13 through 18) positioned within the pocket 132. A valve 174 may selectively allow fluid communication between the central fluid channel 162 and the actuation mechanism 130, 130', and 130" (see FIGS. 13 through 18) to extend and retract the selectively actuatable cutting element 122. For example, a valve 174 may selectively enable fluid communication between the central fluid channel 162 and the actuation mechanism 130, 130', and 130" (see FIGS. 13 through 18). The valve 174 may be electrically actuated (e.g., a piezo-electric valve) and may in electrical communication with and operated by an electronics module 192 that may be located, for example, in the shank 114 of the earth-boring tool 100 such as described in U.S. patent application Ser. Nos. 12/367,433 now U.S. Pat. No. 8,100,196 and 12/901,172 now U.S. Pat. No. 7,987,925 and U.S. Pat. Nos. 7,497,276; 7,506,695; 7,510,026; 7,604,072; 7,849,934; 8,100,196, each to Pastusek et al., each titled "METHOD AND APPARATUS FOR COLLECTING DRILL BIT PERFORMANCE DATA," the disclosure of each of which is incorporated herein in its entirety by this reference.

Figure 19:
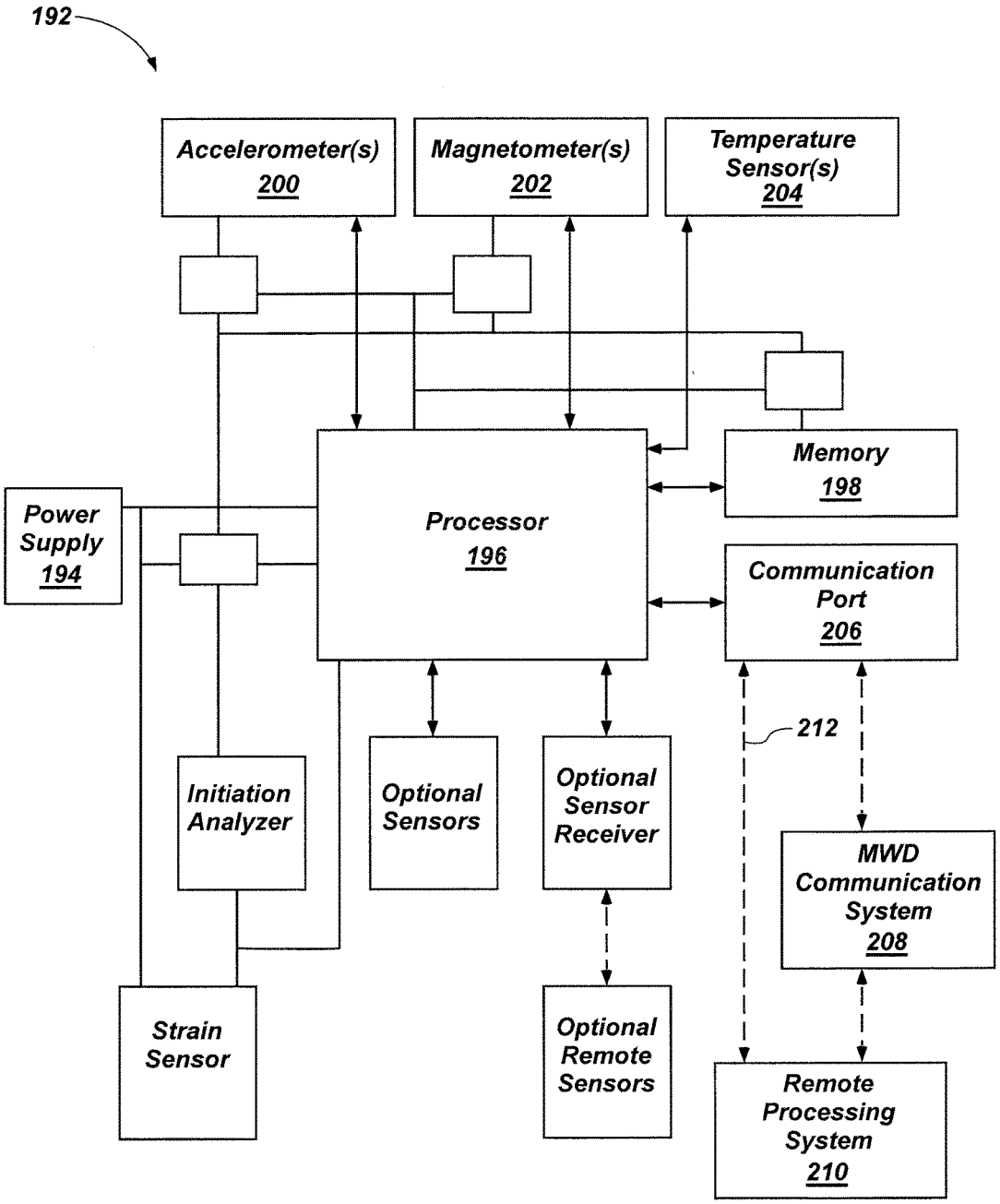
FIG. 19 is a schematic diagram of an electronics module configured to automatically extend and retract a selectively actuatable cutting element.

FIG. 19 is a schematic diagram of an electronics module 192 configured to automatically extend and retract a selectively actuatable cutting element 122. In some embodiments, such as that shown in FIG. 19, the electronics module 192 may include a power supply 194 (e.g., a battery), a processor 196 (e.g., a microprocessor), and a nontransitory memory device 198 (e.g., a random-access memory device (RAM) and read-only memory device (ROM)). The electronics module 192 may additionally include at least one sensor configured to measure physical parameters related to the drilling operation, which may include tool condition, drilling operation conditions, and environmental conditions proximate to the tool. For example, one or more sensors selected from an acceleration sensor 200, a magnetic field sensor 202, and a temperature sensor 204 may be included in the electronics module 192.

A communication port 206 may also be included in the electronics module 192 for communication to external devices such as a measuring-while-drilling (MWD) communication system 208 and a remote processing system 210. The communication port 206 may be configured for a direct communication link 212 to the remote processing system 210 using a direct wire connection or a wireless communication protocol, such as, by way of example only, infrared, BLUETOOTH®, and 802.11a/b/g protocols. Using the direct communication link 212, the electronics module 192 may be configured to communicate with a remote processing system 210 such as, for example, a computer, a portable computer, and a personal digital assistant (PDA) when the earth-boring tool 100 is not downhole. Thus, the direct communication link 212 may be used for a variety of functions, such as, for example, to download software and software upgrades, to enable setup of the electronics module 192 by downloading configuration data, and to upload sample data and analysis data. The communication port 206 may also be used to query the electronics module 192 for information related to the earth-boring tool 100, such as, for example, bit serial number, electronics module serial number, software version, total elapsed time of bit operation, and other long term drill bit data, which may be stored in the memory device 198.

As the valves 174 may be located within the body 102 of the earth-boring tool 100 and the electronics module 192 that operates the valves 174 may be located in the shank 114 of the earth-boring tool 100, the control system for the selectively actuatable cutting elements 122 may be included completely within the earth-boring tool 100.

In some methods of operation of the earth-boring tool 100, the selectively actuatable cutting elements 122 of the earth-boring tool 100 may be initially positioned in a retracted position, such as a fully retracted position, as shown in FIGS. 2, 11, 14, 16, and 18. With the selectively actuatable cutting elements 122 positioned in a retracted position, a borehole section may be formed with the earth-boring tool 100 without engaging the underlying earth formation with the selectively actuatable cutting elements 122. After the borehole section is drilled within the earth formation, one or more of the selectively actuatable cutting elements 122 may then be extended outward relative to the body 102 (e.g., relative to the face 112 of the earth-boring tool 100), to engage with, and perform at least an initial gouging and/or crushing cutting action on the underlying earth formation.

To extend and retract one or more of the selectively actuatable cutting elements 122, a signal may be provided to the electronics module 192. In some embodiments, an acceleration of the earth-boring tool 100 may be utilized to provide a signal to the electronics module 192. For example, the earth-boring tool 100 may be rotated at various speeds, which may be detected by the accelerometers of the acceleration sensor 200. A predetermined rotational speed, or a predetermined series (e.g., a pattern) of various rotational speeds within a given time period, may be utilized to signal the electronics module 192 to extend or retract one or more of the selectively actuatable cutting elements 122. To facilitate reliable detection of accelerations correlating to the predetermined rotational speed signal or signal pattern by the electronics module 192, the weight-on-bit (WOB) may be reduced, such as, for example, to substantially zero pounds (zero Kg) WOB.

In further embodiments, another force acting on the earth-boring tool 100 may be utilized to provide a signal to the electronics module 192. For example, the earth-boring tool 100 may include a strain gage in communication with the electronics module 192 that may detect WOB. A predetermined WOB, or a predetermined series (e.g., pattern) of WOB, may be utilized to signal the electronics module 192 to retract the selectively actuatable cutting elements 122. To facilitate the reliable detection of WOB correlating to the predetermined WOB signal by the electronics module 192, the rotational speed of the earth-boring tool 100 may be maintained at an at least substantially consistent rotational speed (i.e., an at least substantially constant number of rotations per minute (RPM)). In some embodiments, the rotational speed of the earth-boring tool 100 may be maintained at a speed of at least substantially zero RPM while sensing the WOB signal.

In still further embodiments, the signal to extend or retract the selectively actuatable cutting elements 122 may be generated automatically by the electronics module 192 in response to the detection of a threshold change in environmental characteristics or in properties of the earth-boring tool 100 or one or more components thereof. For example, the signal to extend the selectively actuatable cutting elements 122, or to successively extend and retract the selectively actuatable cutting elements 122, may be generated automatically by the electronics module 192 when a temperature detected by the temperature sensor 204 exceeds a threshold amount, when a rate of penetration (ROP) descends below a threshold amount, when a torque on the drill string exceeds a threshold amount, when a specific formation type (e.g., rock) is encountered, when a formation hardness exceeds a threshold amount, when a depth of cut of the shearing cutting elements 108 descends below a threshold amount, when a pressure of a drilling fluid exceeds a threshold amount, when a vibration of the drill string exceeds a threshold amount, when a mechanical specific energy (MSE) (i.e., a total amount of work required to drill the borehole) exceeds or increases by a threshold amount, when a force applied to the drill string (e.g., weight on bit (WOB)) exceeds or increases by a threshold amount, or when a wear on one or more of the shearing cutting elements 108 has exceeded a threshold amount. As other examples, the signal to retract the selectively actuatable cutting elements 122 may be generated automatically by the electronics module 192 when a temperature detected by the temperature sensor 204 descends below a threshold amount, when a rate of penetration (ROP) exceeds a threshold amount, when a torque on the drill string descends below a threshold amount, when a specific formation type (e.g., sand or shale) is encountered, when a formation hardness descends below a threshold amount, when a depth of cut of the shearing cutting elements 108 exceeds a threshold amount, when a pressure of a drilling fluid descends below a threshold amount, when a vibration of the drill string descends below a threshold amount, when an MSE descends below or decreases by a threshold amount, or when a force applied to the drill string descends below or decreases by a threshold amount.

Figure 20:
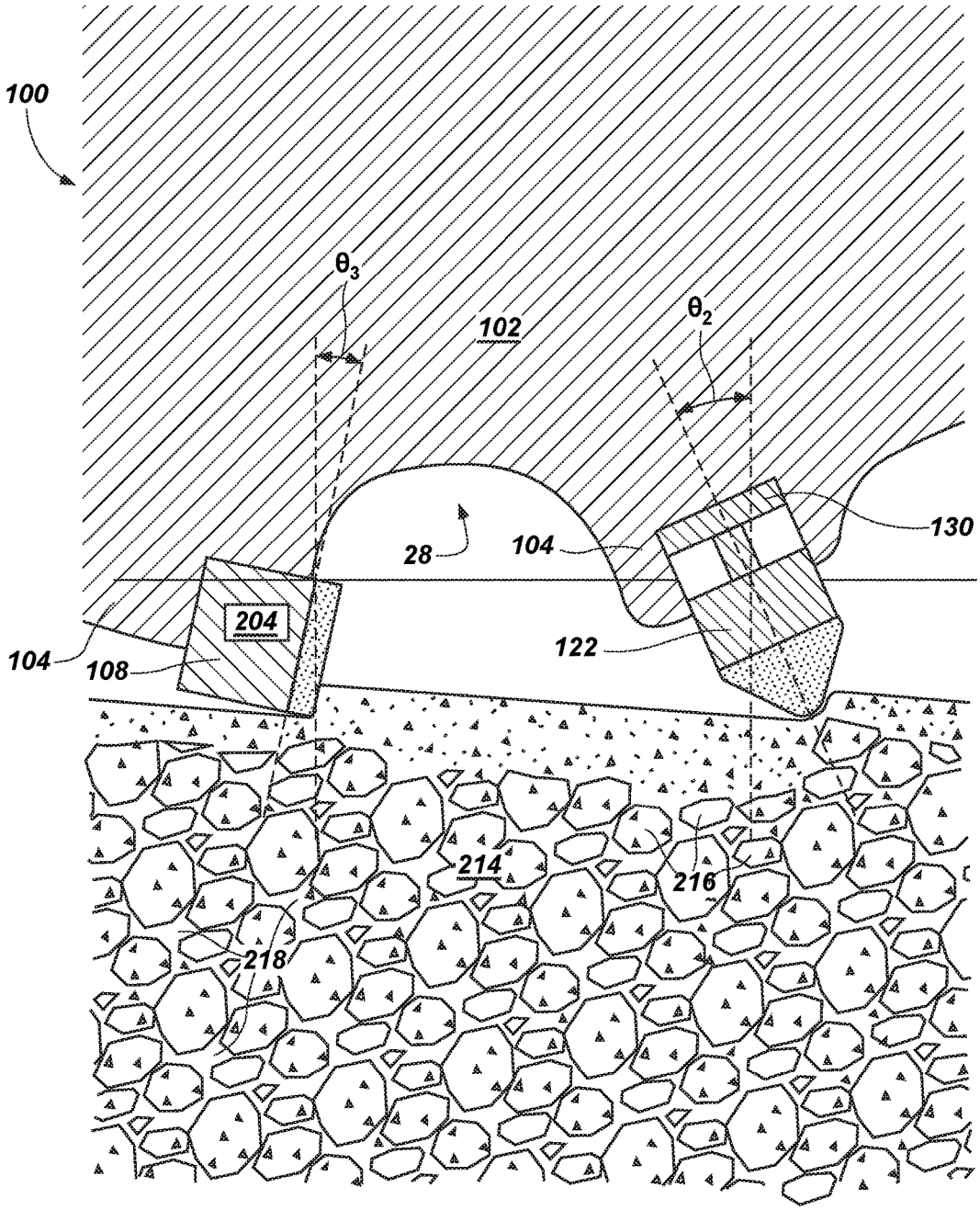
FIG. 20 is a simplified cross-sectional view of a selectively actuatable cutting element engaging an earth formation.

As a specific, nonlimiting example, and with reference to FIG. 20, one or more temperature sensors 204 may be located on or within one or more of the shearing cutting elements 108. The sensor 204 and associated shearing cutting element 108 may be at least substantially as disclosed in U.S. Patent App. Pub. No. 2014/0047776, published Feb. 20, 2014, to Scott et al., the disclosure of which is incorporated herein in its entirety by this reference. For example, the temperature sensor 204 may measure working temperatures at or proximate a working surface of the shearing cutting element 108. When the temperature detected by the temperature sensor 204 reaches or exceeds a threshold maximum value, the selectively actuatable cutting element 122 may be activated. Activation of the selectively actuatable cutting element 122 may relieve at least some of the stresses acting on the shearing cutting element 108, resulting in cooling of the shearing cutting element 108. Accordingly, activation of the selectively actuatable cutting element 122 may reduce the operating temperature of the shearing cutting element 108 below, or maintain the operating temperature of the shearing cutting element 108 at, the threshold maximum temperature. When the temperature detected by the temperature sensor 204 meets or descends below a threshold minimum value, the selectively actuatable cutting element 122 may be deactivated. Accordingly, the selectively actuatable cutting element 122 may be deactivated after adequate cooling of the operating temperature of the shearing cutting element 108 has occurred, enabling the shearing cutting element 108 to resume active, solitary engagement with the earth formation.

In some embodiments, and returning to FIG. 19, one of the foregoing triggering events and its associated signal may result in extension of one selectively actuatable cutting element 122 or a first group (e.g., a first subgroup) of selectively actuatable cutting elements 122, and another of the foregoing triggering events and its associated signal may result in extension of another selectively actuatable cutting element 122 or a second group (e.g., a second subgroup, or an entire number) of selectively actuatable cutting elements 122. For example, one of the foregoing triggering events and its associated signal may result in extension of one selectively actuatable cutting element 122 or a first group (e.g., a first subgroup) of selectively actuatable cutting elements 122 in a specific region of regions 152 through 158 (see FIG. 9) of the face 112 (see FIG. 1) of the earth-boring tool, on a specific blade 104 (see FIG. 1), or on a specific lateral side; and another of the foregoing triggering events and its associated signal may result in extension of another selectively actuatable cutting element 122 or a second group (e.g., a second subgroup, or an entire number) of selectively actuatable cutting elements 122 in a specific region of regions 152 through 158 (see FIG. 9) of the face 112 (see FIG. 1) of the earth-boring tool, on a specific blade 104 (see FIG. 1), on a specific lateral side, or everywhere. As a specific, nonlimiting example, only those selectively actuatable cutting elements 122 in regions exhibiting the highest work rate (e.g., the nose and shoulder regions 154 and 156) may be actuated when the work rate exceeds a threshold amount, and all of the selectively actuatable cutting elements 122 may be actuated when the formation hardness exceeds a threshold amount.

When the electronics module 192 detects a signal to extend one or more of the selectively actuatable cutting elements 122, an electric current may be provided to one or more of the valves 174 corresponding to the respective selectively actuatable cutting elements 122 and the valves 174 may close, cutting off fluid flow therethrough. For example, an electrical circuit may be provided between the power supply 194 (e.g., battery) of the electronics module 192 and the valves 174, as the valves 174 may require relatively little power to operate (e.g., the valves 174 may be piezo-electric valves that may be in a normally open mode and each may require about 5 watts of power to close).

After sending the signal or signals to retract one or more of the selectively actuatable cutting elements 122, electric current may cease to be provided to the valves 174 corresponding to the selectively actuatable cutting elements 122 and the valves 174 may open, enabling fluid flow therethrough. Thereafter, weight may be applied to the earth-boring tool 100 through the drill string, and a force may be applied to the selectively actuatable cutting elements 122 by the underlying formation. Upon opening of the valves 174, the force applied to the selectively actuatable cutting elements 122 by the WOB on the undrilled formation ahead of the earth-boring tool 100 may cause the substantially incompressible fluid within the associated reservoir 170 to flow out of the reservoir 170 through the valve 174 and cause the selectively actuatable cutting elements 122 to be retract toward the body 102, as shown in FIGS. 2, 11, 14, 16, and 18. In embodiments that utilize an open actuation mechanism 130, the incompressible fluid may flow out of the reservoir 170 and mix with the circulating drilling fluid. In embodiments that utilize an actuation mechanism 130', 130" with a second reservoir 184, the incompressible fluid may flow out of the first reservoir 170 and into the second reservoir 184, causing the volume of second reservoir 184 to expand, as shown in FIGS. 16 and 18.

Additional embodiments of actuation mechanisms for selectively extending and retracting the selectively actuatable cutting elements 122 in accordance with this disclosure are disclosed in U.S. Pat. No. 9,080,399, issued Jul. 14, 2015, to Oesterberg, the disclosure of which is incorporated herein in its entirety by this reference.

FIG. 20 is a simplified cross-sectional view of a selectively actuatable cutting element 122 engaging an earth formation 214. Shearing cutting elements 108 attached to blades 104 of earth-boring tools 100 may be oriented at negative back rake angles $\theta_3$. Selectively actuatable cutting elements 122 attached to blades 104 of earth-boring tools 100 may be oriented at positive rake angles $\theta_2$. As the earth-boring tool 100 rotates within the borehole, at least some of the shearing and selectively actuatable cutting elements 108 and 122 may engage the underlying earth formation 214 to facilitate its removal. For example, selectively actuatable cutting elements 122 in the extended position may gouge and crush, which may be particularly effective to remove relatively harder portions, which may also be characterized as strata 216, of the earth formation 214. Shearing cutting elements 108, by contrast, may shear, which may be particularly effective to remove relatively softer portions 218 of the earth formation 214. In addition, selectively actuatable cutting elements 122 may damage the underlying earth formation 214, such as, for example, by crushing the hard portions thereof, creating a damaged zone that has a greater depth than a damaged zone created by shearing cutting elements 108, as shown in FIG. 20.

In some embodiments, at least one of the shearing cutting elements 108 may rotationally follow at least one of the selectively actuatable cutting elements 122 at least partially within a cutting path (e.g., a kerf) traversed by the one or more selectively actuatable cutting elements 122. For example, a shearing cutting element 108 may rotationally follow a selectively actuatable cutting element 122 and remove at least a portion of remaining weakened earth formation by a shearing cutting action after the rotationally leading selectively actuatable cutting element 122 softens the earth formation by a gouging and\or crushing cutting action. In some embodiments, a geometrical center of a planar projection of a cutting portion of the selectively actuatable cutting element 122 (i.e., a footprint of the selectively actuatable cutting element 122 in a plane at least substantially perpendicular to a direction of movement of the selectively actuatable cutting element 122) may be aligned with a geometrical center of a planar projection of a cutting portion of the shearing cutting element 108. In other embodiments, the geometrical center of the planar projection of the cutting portion of the selectively actuatable cutting element 122 may be offset from (e.g., may be laterally, longitudinally, or laterally and longitudinally offset from) the geometrical center of the planar projection of the cutting portion of the shearing cutting element 108. In still other embodiments, the shearing cutting element 108 may be located entirely outside of the cutting path of the selectively actuatable cutting element 122. Other example embodiments of relative positioning for the selectively actuatable cutting element 122 and the shearing cutting element 108 may be at least substantially similar to those disclosed in U.S. Patent App. Pub. No. 2015/0034394, published Feb. 5, 2015, to Gavia et al., the disclosure of which is incorporated herein in its entirety by this reference.

Additional, nonlimiting, example embodiments within the scope of this disclosure include the following:

Embodiment 1

A method of operating an earth-boring tool, comprising: extending a selectively actuatable cutting element outward from a face of the earth-boring tool; at least one of gouging or crushing a portion of an underlying earth formation by a cutting action utilizing the selectively actuatable cutting element in response to extension of the cutting element; and subsequently retracting the selectively actuatable cutting element.

Embodiment 2

The method of Embodiment 1, wherein at least one of gouging or crushing the portion of the underlying earth formation by the cutting action utilizing the selectively actuatable cutting element comprises crushing the portion of the underlying earth formation by contacting the underlying earth formation with a nonplanar surface of the selectively actuatable cutting element.

Embodiment 3

The method of Embodiment 2, wherein at least one of gouging or crushing the portion of the underlying earth formation by contacting the underlying earth formation with the nonplanar surface of the selectively actuatable cutting element comprises at least one of gouging or crushing the portion of the underlying earth formation by contacting the underlying earth formation with a hemispherical surface of the selectively actuatable cutting element.

Embodiment 4

The method of Embodiment 2, wherein at least one of gouging or crushing the portion of the underlying earth formation by contacting the underlying earth formation with the nonplanar surface of the selectively actuatable cutting element comprises at least one of gouging or crushing the portion of the underlying earth formation by contacting the underlying earth formation with a chisel-shaped surface of the selectively actuatable cutting element.

Embodiment 5

The method of Embodiment 1, wherein at least one of gouging or crushing the portion of the underlying earth formation by the cutting action utilizing the selectively actuatable cutting element comprises gouging the portion of the underlying earth formation by contacting the underlying earth formation with a planar surface of the selectively actuatable cutting element.

Embodiment 6

The method of Embodiment 5, wherein gouging the portion of the underlying earth formation by contacting the underlying earth formation with the planar surface of the selectively actuatable cutting element comprises gouging the portion of the underlying earth formation by contacting the underlying earth formation with the planar surface of an at least substantially cylindrical selectively actuatable cutting element.

Embodiment 7

The method of any one of Embodiments 1 through 6, wherein at least one of gouging or crushing the portion of the underlying earth formation by the cutting action utilizing the selectively actuatable cutting element comprises at least one of gouging or crushing the portion of the underlying earth formation by contacting the underlying earth formation with a polycrystalline diamond material of the selectively actuatable cutting element.

Embodiment 8

The method of any one of Embodiments 1 through 6, wherein at least one of gouging or crushing the portion of the underlying earth formation by the cutting action utilizing the selectively actuatable cutting element comprises at least one of gouging or crushing the portion of the underlying earth formation by contacting the underlying earth formation with a tungsten carbide material of the selectively actuatable cutting element.

Embodiment 9

The method of Embodiment 8, wherein at least one of gouging or crushing the portion of the underlying earth formation by the cutting action utilizing the selectively actuatable cutting element comprises at least one of gouging or crushing the portion of the underlying earth formation by contacting the underlying earth formation with a diamond-impregnated tungsten carbide material of the selectively actuatable cutting element.

Embodiment 10

The method of any one of Embodiments 1 through 9, wherein at least one of gouging or crushing the portion of the underlying earth formation by the cutting action utilizing the selectively actuatable cutting element comprises at least one of gouging or crushing the portion of the underlying earth formation by contacting the underlying earth formation with the selectively actuatable cutting element in a nose region of the face of the earth-boring tool.

Embodiment 11

The method of any one of Embodiments 1 through 9, wherein at least one of gouging or crushing the portion of the underlying earth formation by the cutting action utilizing the selectively actuatable cutting element comprises at least one of gouging or crushing the portion of the underlying earth formation by contacting the underlying earth formation with the selectively actuatable cutting element in a shoulder region of the face of the earth-boring tool.

Embodiment 12

The method of any one of Embodiments 1 through 11, wherein extending the selectively actuatable cutting element outward from the face of the earth-boring tool comprises extending the selectively actuatable cutting element outward from the face of the earth-boring tool when a temperature detected by a temperature sensor operatively connected to the selectively actuatable cutting element exceeds a threshold amount, when a rate of penetration of the earth-boring tool descends below a threshold amount, when a torque on the earth-boring tool exceeds a threshold amount, when a predetermined formation type is encountered, when a formation hardness exceeds a threshold amount, when a depth of cut of a shearing cutting element mounted to the earth-boring tool descends below a threshold amount, when a pressure of a drilling fluid exceeds a threshold amount, or when a vibration of the earth-boring tool exceeds a threshold amount.

Embodiment 13

The method of any one of Embodiments 1 through 12, further comprising leaving another selectively actuatable cutting element mounted to the earth-boring tool in a retracted state when extending the selectively actuatable cutting element outward from the face of the earth-boring tool.

Embodiment 14

The method of any one of Embodiments 1 through 13, further comprising periodically extending and retracting the selectively actuatable cutting element.

Embodiment 15

The method of any one of Embodiments 1 through 13, further comprising leaving the selectively actuatable cutting element in an extended state for at least one minute before retracting the selectively actuatable cutting element.

Embodiment 16

The method of Embodiment 15, further comprising shearing another portion of the underlying earth formation by a shearing cutting action utilizing the shearing cutting element after at least one of gouging or crushing the portion of the underlying earth formation by the cutting action utilizing the selectively actuatable cutting element in response to extension of the cutting element.

Embodiment 17

The method of any one of Embodiments 1 through 16, further comprising directing a jet of fluid toward a gouged and or crushed portion of the underlying earth formation to propagate cracks in the gouged and or crushed portion of the underlying earth formation.

Embodiment 18

The method of any one of Embodiments 1 through 17, further comprising directing an ultrasonic wave toward a gouged and or crushed portion of the underlying earth formation to propagate cracks in the gouged and or crushed portion of the underlying earth formation.

Embodiment 19

An earth-boring tool, comprising: a body; blades extending outward from the body to a face; shearing cutting elements mounted to the blades proximate rotationally leading surfaces of the blades; and a selectively actuatable cutting element mounted to a blade, the selectively actuatable cutting element configured to move between a retracted state in which the selectively actuatable cutting element does not engage with an underlying earth formation and an extended state in which the selectively actuatable cutting element engages with the underlying earth formation, the selectively actuatable cutting element configured to perform at least one of a gouging or crushing cutting action at least upon initial positioning into the extended state.

Embodiment 20

The earth-boring tool of Embodiment 19, wherein the selectively actuatable cutting element comprises a nonplanar cutting face positioned and oriented to engage with the underlying earth formation when the selectively actuatable cutting element is in the extended position.

Embodiment 21

The earth-boring tool of Embodiment 19 or Embodiment 20, wherein the selectively actuatable cutting element is located in one of a nose region and a cone region of the face.

Embodiment 22

The earth-boring tool of any one of Embodiments 19 through 21, wherein the selectively actuatable cutting element is configured to move from the retracted position to the extended position when a temperature detected by a temperature sensor operatively connected to the selectively actuatable cutting element exceeds a threshold amount, when a rate of penetration of the earth-boring tool descends below a threshold amount, when a torque on the earth-boring tool exceeds a threshold amount, when a predetermined formation type is encountered, when a formation hardness exceeds a threshold amount, when a depth of cut of a shearing cutting element mounted to the earth-boring tool descends below a threshold amount, when a pressure of a drilling fluid exceeds a threshold amount, or when a vibration of the earth-boring tool exceeds a threshold amount.

Embodiment 23

A method of operating an earth-boring tool, comprising: activating a selectively activatable hydraulic fracturing device secured to the earth-boring tool to impact an underlying earth formation with a fluid from the selectively activatable hydraulic fracturing device; at least one of initiating or propagating a crack in a portion of the underlying earth formation utilizing the fluid in response to activation of the selectively activatable hydraulic fracturing device; and subsequently deactivating the selectively activatable hydraulic fracturing device.

Embodiment 24

The method of Embodiment 23, further comprising: extending a selectively actuatable cutting element outward from a face of the earth-boring tool; at least one of gouging or crushing the underlying earth formation utilizing the selectively actuatable cutting element in response to extension of the cutting element; and subsequently retracting the selectively actuatable cutting element.

Embodiment 25

The method of Embodiment 24, wherein activating the selectively activatable hydraulic fracturing device to impact the underlying earth formation with the fluid comprises directing the fluid at a portion of the underlying earth formation impacted by the selectively actuatable cutting element and wherein at least one of initiating or propagating the crack in the portion of the underlying earth formation utilizing the fluid comprises propagating the crack.

Embodiment 26

The method of Embodiment 25, wherein directing the fluid at the portion of the underlying earth formation impacted by the selectively actuatable cutting element comprises directing the fluid at a portion of the underlying earth formation rotationally trailing the selectively actuatable cutting element.

Embodiment 27

The method of any one of Embodiments 24 through 26, wherein the selectively activatable hydraulic fracturing device is secured to, and located on, the selectively actuatable cutting element and wherein activating the selectively activatable hydraulic fracturing device comprises activating the selectively activatable hydraulic fracturing device after extending the selectively actuatable cutting element.

Embodiment 28

The method of any one of Embodiments 24 through 27, further comprising removing the portion of the underlying earth formation by a shearing cutting action utilizing a shearing cutting element secured to the earth-boring tool.

Embodiment 29

The method of Embodiment 28, wherein activating the selectively activatable hydraulic fracturing device to impact the underlying earth formation with the fluid comprises directing the fluid at a location rotationally between the selectively actuatable cutting element and the shearing cutting element.

Embodiment 30

The method of any one of Embodiments 23 through 29, wherein at least one of initiating or propagating the crack in the portion of the underlying earth formation utilizing the fluid comprises at least one of gouging or crushing the portion of the underlying earth formation utilizing the fluid in response to activation of the selectively activatable hydraulic fracturing device.

Embodiment 31

The method of claim any one of Embodiments 23 through 30, further comprising removing the portion of the underlying earth formation by a shearing cutting action utilizing a shearing cutting element secured to the earth-boring tool.

Embodiment 32

The method of Embodiment 31, wherein activating the selectively activatable hydraulic fracturing device to impact the underlying earth formation with the fluid comprises directing the fluid at a location rotationally in front of the shearing cutting element.

Embodiment 33

The method of any one of Embodiments 23 through 32, wherein activating the selectively activatable hydraulic fracturing device comprises activating the selectively activatable hydraulic fracturing device when a temperature detected by a temperature sensor operatively connected to the selectively activatable hydraulic fracturing device exceeds a threshold amount, when a rate of penetration of the earth-boring tool descends below a threshold amount, when a torque on the earth-boring tool exceeds a threshold amount, when a predetermined formation type is encountered, when a formation hardness exceeds a threshold amount, when a depth of cut of a shearing cutting element mounted to the earth-boring tool descends below a threshold amount, when a pressure of a drilling fluid exceeds a threshold amount, or when a vibration of the earth-boring tool exceeds a threshold amount.

Embodiment 34

The method of any one of Embodiments 23 through 33, further comprising leaving another selectively activatable hydraulic fracturing device mounted to the earth-boring tool in a deactivated state when activating the selectively activatable hydraulic fracturing device.

Embodiment 35

The method of any one of Embodiments 23 through 34, further comprising periodically activating and deactivating the selectively activatable hydraulic fracturing device.

Embodiment 36

The method of any one of Embodiments 23 through 34, further comprising leaving the selectively activatable hydraulic fracturing device in an activated state for at least one minute before deactivating the selectively actuatable cutting element.

Embodiment 37

An earth-boring tool, comprising: a body; blades extending outward from the body to a face; shearing cutting elements mounted to the blades proximate rotationally leading surfaces of the blades; and a selectively activatable hydraulic fracturing device mounted to a blade, the selectively activatable hydraulic fracturing device configured to transition between an activated state in which fluid is permitted to flow through the selectively activatable hydraulic fracturing device to engage with an underlying earth formation and a deactivated state in which fluid does not flow through the selectively activatable hydraulic fracturing device, the selectively activatable hydraulic fracturing device configured to perform at least one of crack initiation or crack propagation within the earth formation at least upon initial activation into the activated state.

Embodiment 38

The earth-boring tool of Embodiment 37, wherein the selectively activatable hydraulic fracturing device is oriented to direct a jet of the fluid at a location rotationally in front of an associated one of the shearing cutting elements.

Embodiment 39

The earth-boring tool of Embodiment 37 or Embodiment 38, wherein the body comprises a fluid passageway extending from within the body to an outer surface of the blade and wherein the selectively activatable hydraulic fracturing device comprises a selectively openable nozzle positioned at least partially in the fluid passageway.

Embodiment 40

The earth-boring tool of any one of Embodiments 37 through 39, further comprising a selectively actuatable cutting element mounted to the blade, the selectively actuatable cutting element configured to move between a retracted state in which the selectively actuatable cutting element does not engage with an underlying earth formation and an extended state in which the selectively actuatable cutting element engages with the underlying earth formation, the selectively actuatable cutting element configured to perform at least one of a gouging or crushing cutting action at least upon initial positioning into the extended state.

Embodiment 41

The earth-boring tool of Embodiment 40, wherein the selectively activatable hydraulic fracturing device is secured to, and located on, the selectively actuatable cutting element.

Embodiment 42

The earth-boring tool of any one of Embodiments 37 through 41, wherein the selectively activatable hydraulic fracturing device is configured to transition from the deactivated state to the activated state when a temperature detected by a temperature sensor operatively connected to the selectively activatable hydraulic fracturing device exceeds a threshold amount, when a rate of penetration of the earth-boring tool descends below a threshold amount, when a torque on the earth-boring tool exceeds a threshold amount, when a predetermined formation type is encountered, when a formation hardness exceeds a threshold amount, when a depth of cut of a shearing cutting element mounted to the earth-boring tool descends below a threshold amount, when a pressure of a drilling fluid exceeds a threshold amount, or when a vibration of the earth-boring tool exceeds a threshold amount.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A method of operating an earth-boring tool, comprising:

extending an extensible member outward from a face of the earth boring tool, the extensible member secured to the earth-boring tool, a selectively activatable hydraulic fracturing device being mounted to, and extensible with, the extensible member, activating the selectively activatable hydraulic fracturing device to impact an underlying earth formation with a fluid from the selectively activatable hydraulic fracturing device;

at least one of initiating or propagating a crack in a portion of the underlying earth formation utilizing the fluid in response to activation of the selectively activatable hydraulic fracturing device;

subsequently deactivating the selectively activatable hydraulic fracturing device; and subsequently retracting the extensible member and the selectively activatable hydraulic fracturing device.

2. The method of claim 1, wherein the extensible member comprises a selectively actuatable cutting element and further comprising:

extending the selectively actuatable cutting element outward from the face of the earth-boring tool;

at least one of gouging or crushing the underlying earth formation utilizing the selectively actuatable cutting element in response to extension of the cutting element; and subsequently retracting the selectively actuatable cutting element.

3. The method of claim 2, wherein activating the selectively activatable hydraulic fracturing device to impact the underlying earth formation with the fluid comprises directing the fluid at a portion of the underlying earth formation impacted by the selectively actuatable cutting element and wherein at least one of initiating or propagating the crack in the portion of the underlying earth formation utilizing the fluid comprises propagating the crack.

4. The method of claim 3, wherein directing the fluid at the portion of the underlying earth formation impacted by the selectively actuatable cutting element comprises directing the fluid at a portion of the underlying earth formation rotationally trailing the selectively actuatable cutting element.

5. The method of claim 2, wherein the selectively activatable hydraulic fracturing device is secured to, and located on, the selectively actuatable cutting element and wherein activating the selectively activatable hydraulic fracturing device comprises activating the selectively activatable hydraulic fracturing device after extending the selectively actuatable cutting element.

6. The method of claim 2, further comprising removing the portion of the underlying earth formation by a shearing cutting action utilizing a shearing cutting element secured to the earth-boring tool.

7. The method of claim 6, wherein activating the selectively activatable hydraulic fracturing device to impact the underlying earth formation with the fluid comprises directing the fluid at a location rotationally between the selectively actuatable cutting element and the shearing cutting element.

8. The method of claim 1, wherein at least one of initiating or propagating the crack in the portion of the underlying earth formation utilizing the fluid comprises at least one of gouging or crushing the portion of the underlying earth formation utilizing the fluid in response to activation of the selectively activatable hydraulic fracturing device.

9. The method of claim 1, further comprising removing the portion of the underlying earth formation by a shearing cutting action utilizing a shearing cutting element secured to the earth-boring tool.

10. The method of claim 9, wherein activating the selectively activatable hydraulic fracturing device to impact the underlying earth formation with the fluid comprises directing the fluid at a location rotationally in front of the shearing cutting element.

11. The method of claim 1, wherein activating the selectively activatable hydraulic fracturing device comprises activating the selectively activatable hydraulic fracturing device when a temperature detected by a temperature sensor operatively connected to the selectively activatable hydraulic fracturing device exceeds a threshold amount, when a rate of penetration of the earth-boring tool descends below a threshold amount, when a torque on the earth-boring tool exceeds a threshold amount, when a predetermined formation type is encountered, when a formation hardness exceeds a threshold amount, when a depth of cut of a shearing cutting element mounted to the earth-boring tool descends below a threshold amount, when a pressure of a drilling fluid exceeds a threshold amount, or when a vibration of the earth-boring tool exceeds a threshold amount.

12. The method of claim 1, further comprising leaving another selectively activatable hydraulic fracturing device mounted to the earth-boring tool in a deactivated state when activating the selectively activatable hydraulic fracturing device.

13. The method of claim 1, further comprising periodically activating and deactivating the selectively activatable hydraulic fracturing device.

14. The method of claim 1, further comprising leaving the selectively activatable hydraulic fracturing device in an activated state for at least one minute before deactivating the selectively actuatable cutting element.

15. An earth-boring tool, comprising:

a body;

blades extending outward from the body to a face;

shearing cutting elements mounted to the blades proximate rotationally leading surfaces of the blades;

an extensible member mounted to one of the blades, the extensible member configured to selectively extend outward from the face to an extended state, and retract back toward the face to a retracted state; and a selectively activatable hydraulic fracturing device mounted to, and extensible with, the extensible member, the selectively activatable hydraulic fracturing device configured to transition between an activated state when the extensible member is in the extended state in which fluid is permitted to flow through the selectively activatable hydraulic fracturing device to engage with an underlying earth formation and a deactivated state when the extensible member is in the retracted state in which fluid does not flow through the selectively activatable hydraulic fracturing device, the selectively activatable hydraulic fracturing device configured to perform at least one of crack initiation or crack propagation within the underlying earth formation at least upon initial activation into the activated state.

16. The earth-boring tool of claim 15, wherein the selectively activatable hydraulic fracturing device is oriented to direct a jet of the fluid at a location rotationally in front of an associated one of the shearing cutting elements.

17. The earth-boring tool of claim 15, wherein the body comprises a fluid passageway extending from within the body to an outer surface of the blade and wherein the selectively activatable hydraulic fracturing device comprises a selectively openable nozzle positioned at least partially in the fluid passageway.

18. The earth-boring tool of claim 15, wherein the extensible member comprises a selectively actuatable cutting element mounted to the blade, the selectively actuatable cutting element configured to move between the retracted state in which the selectively actuatable cutting element does not engage with an underlying earth formation and the extended state in which the selectively actuatable cutting element engages with the underlying earth formation, the selectively actuatable cutting element configured to perform at least one of a gouging or crushing cutting action at least upon initial positioning into the extended state.

19. The earth-boring tool of claim 15, wherein the selectively activatable hydraulic fracturing device is configured to transition from the deactivated state to the activated state when a temperature detected by a temperature sensor operatively connected to the selectively activatable hydraulic fracturing device exceeds a threshold amount, when a rate of penetration of the earth-boring tool descends below a threshold amount, when a torque on the earth-boring tool exceeds a threshold amount, when a predetermined formation type is encountered, when a formation hardness exceeds a threshold amount, when a depth of cut of a shearing cutting element mounted to the earth-boring tool descends below a threshold amount, when a pressure of a drilling fluid exceeds a threshold amount, or when a vibration of the earth-boring tool exceeds a threshold amount.

* * * * *